US006132069A

United States Patent [19]

Sato et al.

[11] Patent Number: 6,132,069

[45] Date of Patent: Oct. 17, 2000

[54] LIGHT BODY, LIGHT BODY MOUNTING BASE AND EMBEDDED LIGHTING EQUIPMENT

[75] Inventors: Katunori Sato, Tochigi; Kazuaki Murata, Tokyo, both of Japan

[73] Assignee: Moriyama Sangyo Kabushiki Kaisha, Japan

[21] Appl. No.: 09/043,520

[22] PCT Filed: Jul. 7, 1997

[86] PCT No.: PCT/JP97/02339

§ 371 Date: Mar. 19, 1998

§ 102(e) Date: Mar. 19, 1998

[87] PCT Pub. No.: WO98/03817

PCT Pub. Date: Jan. 29, 1998

[30] Foreign Application Priority Data

Jul. 19, 1996 [JP] Japan ..... 8-191168
Jul. 19, 1996 [JP] Japan ..... 8-191169

[51] Int. Cl.[7] ..... F21V 19/00

[52] U.S. Cl. ..... 362/365; 362/148; 362/226; 362/294; 362/368

[58] Field of Search ..... 439/537, 672, 439/332, 334; 362/147, 148, 226, 294, 345, 364, 365, 368, 408, 304, 305

[56] References Cited

U.S. PATENT DOCUMENTS

| | | | |
|---|---|---|---|
| 1,509,839 | 9/1924 | Kuhn | 439/334 |
| 3,711,702 | 1/1973 | Adra | 362/345 |
| 3,798,584 | 3/1974 | Person | 439/537 |
| 3,985,417 | 10/1976 | Fenton | 439/537 |
| 4,764,854 | 8/1988 | Matsune et al. | 362/226 |
| 4,794,498 | 12/1988 | Neumeier | 362/362 |
| 4,819,133 | 4/1989 | Kochi et al. | 362/226 |
| 4,822,302 | 4/1989 | Dorleans | 362/226 |
| 4,922,388 | 5/1990 | Freudenreich | 362/226 |
| 4,982,131 | 1/1991 | Meyer et al. | 362/226 |
| 5,077,650 | 12/1991 | Cestari | 362/365 |
| 5,119,276 | 6/1992 | Suzuki | 362/305 |
| 5,394,315 | 2/1995 | Ahroni | 362/226 |
| 5,581,448 | 12/1996 | Harwood | 362/147 |
| 5,584,575 | 12/1996 | Fickel | 362/364 |

FOREIGN PATENT DOCUMENTS

| | | |
|---|---|---|
| 60-140602 | 7/1985 | Japan . |
| 62-150803 | 9/1987 | Japan . |
| 236116 | 3/1990 | Japan . |
| 02192918 | 2/1993 | Japan . |

*Primary Examiner*—Alan Cariaso
*Attorney, Agent, or Firm*—Morrison Law Firm

[57] ABSTRACT

An embedded type lighting device is formed by assembling a light body to the light body mounting base which is to be mounted to a fitting face. The light body provides the lamp structure made of a plastic material, the lamp socket, and the connector for electrical connection and mechanical connection to the light body mounting base. The light body mounting base includes a base structure made of a plastic material, a terminal block, and connection means for receiving, electrically connecting and mechanically supporting the connector of the light body. The light body is connected both electrically and mechanically to the light body mounting base by the connector. Yet, it is possible to omit a special insulation structure with regard to the terminal and the connection means by making the light body structure and the base structure of a plastic material. Thus the workability of the light body is improved and the construction of both the light body and the light body mounting base is simplified.

26 Claims, 12 Drawing Sheets

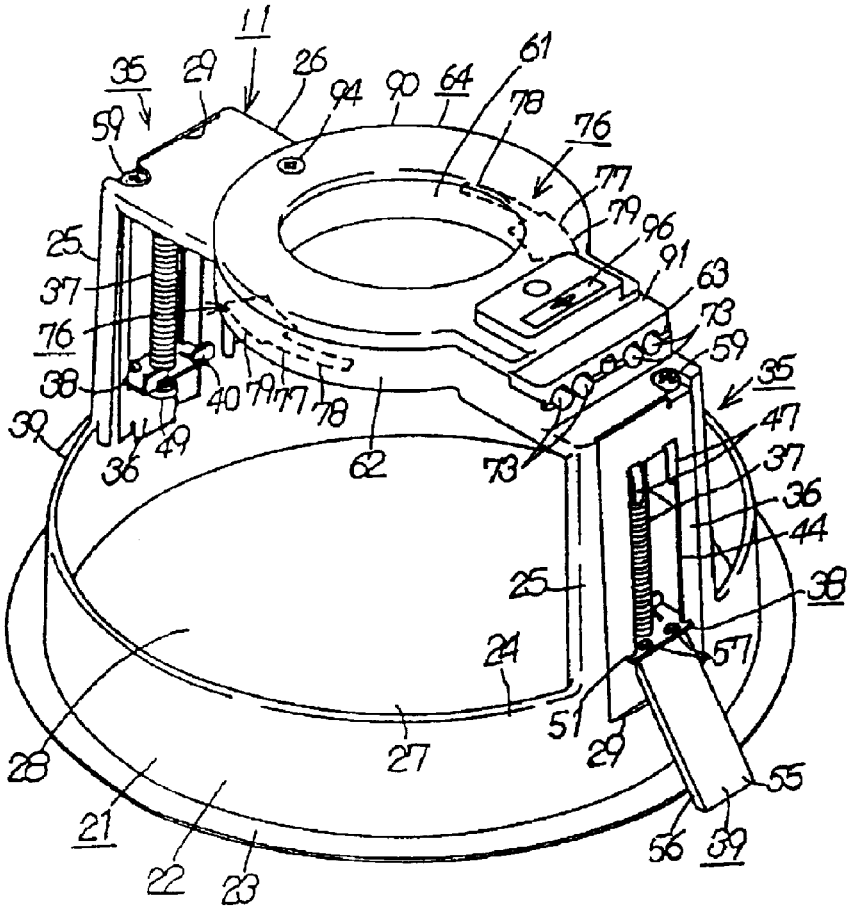
Fig. 1
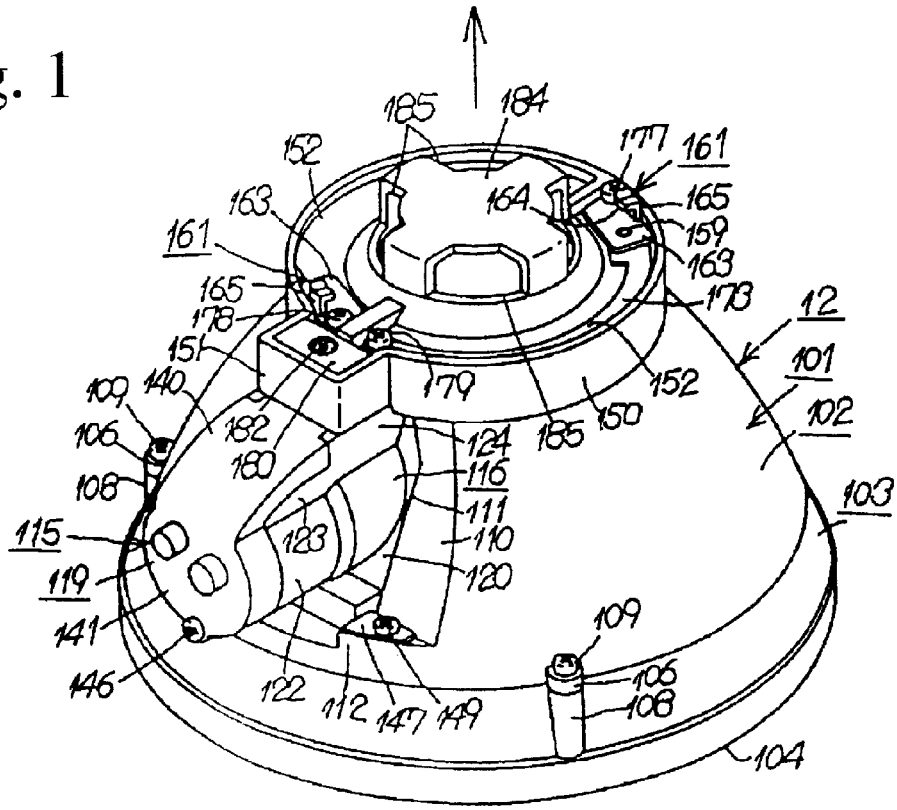

LIGHT BODY, LIGHT BODY MOUNTING BASE AND EMBEDDED LIGHTING EQUIPMENT

TECHNICAL FIELD

The present invention relates to a light body for lighting, a light body mounting base for mounting the light body, and an embedded lighting equipment providing a light body and a light body mounting base

BACKGROUND

A ceiling light fixture, for projecting light downward, conventionally has a light body mounting base to be embedded in a ceiling board (a fitting surface) and a light body to be mounted in the light body mounting base. These are generally supplied as separate items.

In a ceiling fixture like this, the light body mounting base is previously embedded in the ceiling board. An electric power cable passes through the rear of an inside of the light body mounting base. The cable is connected to a terminal block of the light body. The light body is then inserted inside the light body mounting base. A stopper mechanism of the light body side is hooked mechanically to a stopper mechanism of the light body mounting base side.

However, there is a problem that, when mounting the light body to the light body mounting base, it takes time and labor to assemble the light body because electrical connection and mechanical connection are made in separate operations. Further, since the light body mounting base and the light body are generally made of metal, an insulation structure is required to provide electric insulation. These factors complicate the installation process.

What is more, when mounting the light body to the light body mounting base, since the stopper mechanism of the light body side must be hooked mechanically to the stopper mechanism of the light body mounting base side while the light body is inserted inside the light body mounting base, alignment of the two stopper mechanisms is complicated by the inability of the installer to visually confirm the alignment from the outside. This increases the time and labor to install the light body.

Also, when installing an ordinary ceiling fixture to a ceiling board, a frame part of the ceiling fixture is inserted into a fitting hole formed in the ceiling board. A stopper metal arranged in a side face of the frame part is pushed sideways and pulled down by inserting a hand inside the frame part (an inside space where a lamp and a reflection plate are mounted). Thus the frame part is installed in the ceiling board by holding the ceiling board with a flange part of the frame which is hidden behind the front surface of the ceiling board and the stopper metal which is hidden by the rear face of the ceiling board.

However, according to a configuration like this, there is a problem that, since the stopper metal must be handled by inserting the hand inside the frame part, operation is awkward.

To cope with these problems, U.S. Pat. No. 5,331,531 discloses a configuration in which a feed screw is provided in a side face of a frame part so as to freely rotate along a vertical direction. A nut is threaded onto the feed screw. A stopper metal is attached to the nut so as to freely rotate. Rotation of the feed screw causes the stopper metal to advance and retreat with regard to the frame part. The stopper metal, when the nut moves to its upper end by rotational of the feed screw, is allowed to lay down by rotating the same toward an inside of the frame part so as not to engage the ceiling board. When the nut moves to its lower end, the stopper metal is forcibly rotated to protrude toward a side of the frame part where it can engage a rear face of the ceiling board. When the frame part is embedded into the ceiling board, it is embedded into the ceiling board under a condition the stopper metal lays inside of the frame part. The feed screw is operated by way of an end part of the feed screw facing a lower face of the frame part when the nut is moved toward the lower end side, and thus the frame part contacts the rear face of the ceiling by forcibly moving the stopper metal outside the frame part. Thereby, the stopper metal can be operated without inserting a hand inside the frame part.

However, according to the configuration shown in U.S. Pat. No. 5,331,531, when the nut is moved to the upper end side, since it is possible to lay down the stopper metal by rotating it toward the inside of the frame part and oppositely it is also possible to protrude the stopper metal from the frame part by rotating the same in an outside direction, the stopper metal may protrude from the frame part during the process of embedding the frame part into the ceiling board. Thus, there is a problem in work such that the protruded stopper metal is caught by the ceiling board and interferes with the installation.

OBJECTS AND SUMMARY OF THE INVENTION

It is an object, therefore, of the present invention to provide a light body, a light body mounting base and an embedded lighting equipment that can improve workability and simplify configuration.

It is a further object of the invention to provide an embedded ceiling fixture in which a light body mounting base is fixed to a ceiling tile by a pair of tilting engagement pieces. The engagement pieces are resiliently biased outward so that the light body mounting base can be forced upward through a hole in the ceiling tile, thereby forcing the engagement pieces inward. Once the ends of the engagement pieces pass the upper side of the ceiling tile, they spring outward to temporarily hold the light body mounting base in position. Then, the engagement pieces are moved downward by adjustment screws until a flange about the perimeter of the light body mounting base is moved into tight clamping relationship to the lower surface of the ceiling tile.

Briefly stated, the present invention provides an embedded type lighting device that is formed by assembling a light body to the light body mounting base which is to be mounted to a fitting face. The light body provides the lamp structure made of a plastic material, the lamp socket, and the connector for electrical connection and mechanical connection to the light body mounting base. The light body mounting base includes a base structure made of a plastic material, a terminal block, and connection means for receiving, electrically connecting and mechanically supporting the connector of the light body. The light body is connected both electrically and mechanically to the light body mounting base by the connector. Yet, it is possible to omit a special insulation structure with regard to the terminal and the connection means by making the light body structure and the base structure of a plastic material. Thus the workability of the light body is improved and the construction of both the light body and the light body mounting base is simplified.

According to an embodiment of the invention, there is provided a light body comprising: a plastic light body structure having a concave main reflection surface with respect to which a light emitting part of a lamp is located, a lamp socket arranged in the light body structure for positioning the light emitting part of lamp with respect to the main reflection plate, and a connector fixed to the light body structure for supplying a lamp electric power to the lamp socket by way of electric connection and for mechanically supporting the light body structure.

According to a feature of the invention, there is provided a light body mounting base comprising: a plastic base structure which is arranged to a fitting hole formed in a fitting face and has a frame part enabling fitting of a light body having a connector, a terminal block which is arranged to the base structure and enables connection of an electric power cable and a feed wire, and a connection means which is arranged to the base structure and connected electrically to the terminal block for receiving and electrically connecting and mechanically supporting the connector of the light body.

According to a further feature of the invention, there is provided an embedded type lighting device comprising: a plastic light body structure having a concave main reflection plate with respect to which a light emitting part of a lamp is located, a lamp socket in the light body structure for positioning the light emitting part of the lamp within the main reflection plate, and a light body mounting base comprising a light body having a connector which is fixed to the light body structure for supplying a lamp electric power to the lamp socket by electrical connection and for mechanically supporting the light body structure, a plastic base structure for fitting into a fitting hole formed in a fitting face, a frame part of the plastic base structure for fitting a light body having a connector, a terminal block which is arranged in the base structure for connecting an electric power cable and a feed wire, and a connection means which is arranged in the base structure and connected electrically to the terminal block for receiving, electrically connecting and mechanically supporting the connector of the light body.

A light body according to the present invention provides a plastic light body structure having a concave main reflection plate to which a light emitting part of a lamp is located oppositely, a lamp socket arranged in the light body structure for positioning said light emitting part of lamp within said main reflection plate, and a connector fixed to said light body structure for supplying a lamp electric power to said lamp socket by way of electric connection and for mechanically supporting the light body structure. By this, it is possible to connect the light body both electrically and mechanically, for example, to a light body mounting base for mounting the light body, and yet by making the light body structure for fixing the connector with a plastic material, it is possible to exclude a special insulation structure with regard to the connector, and thus it is possible to improve workability of the light body and simplify the light body construction.

Also, for the Light body structure, a plastic material having a specific gravity of below 2 and having a thermal conductivity of at least 3 cal/cm$^3$ is used. By this, even with a plastic light body structure, it is possible to improve heat dissipation of the lamp during lighting.

Further, for the light body structure, a glass fiber reinforced plastic material having a specific gravity of below 2 and a thermal conductivity of at least 3 cal/cm$^3$ is used. By this, even with a plastic light body structure, it is possible to improve both a rigidity and heat resistance.

Still further, the light body structure has a tubular light control body which is connected to a lower end of the main reflection plate. By this, it is possible to choose an optional light control body by commonly using the main reflection plate, and obtain an optional light control effect.

Still further, the light body structure has a projection part which is formed monolithically at a top part of the light body structure. By this, when mounting a light body, for example, to the Light body mounting base, it is possible to easily incorporate the light body into a prescribed position of the light body mounting base by way of the projection part which functions as a guide and easily position the connector with regard to the light body mounting base, and thus it is possible to improve workability of the light body.

Still further, the light body structure has a projection part which is formed monolithically at a top part of the light body structure and a ventilation hole which is formed around the projection part. By this, when mounting a light body, for example, to the light body mounting base, it is possible to easily incorporate the light body into a prescribed position of the light body mounting base by way of the projection part which functions as a guide and easily position the connector with regard to the light body mounting base, and thus it is possible to improve workability of the light body. What is more, through the ventilation hole of the projection part, it is possible to secure ventilation between an inside and outside of the light body structure and improve heat dissipation.

Still further, the light body structure has a projection part which is formed monolithically at a top part of the light body structure and a ventilation hole which is formed around the projection part, and the lamp socket is arranged in a middle part of said light body structure. By this, when mounting a light body, for example, to the light body mounting base, it is possible to easily incorporate the light body into a prescribed position of the light body mounting base by way of the projection part which functions as a guide and easily position the connector with regard to the light body mounting base, and thus it is possible to improve workability of the light body. What is more, through the ventilation hole of the projection part, it is possible to secure ventilation between the inside and outside of the light body structure and improve heat dissipation. Further, by arranging the lamp socket in the middle part of the light body structure, it is possible to compose the light body shallower in shape compared with a case in which the light body is arranged at the top part of the light body structure.

Still further, the light body structure has a projection part which is formed monolithically at a top part of the light body structure, and the connector is a hook type connector arranged around said projection part. By this, when mounting a light body, for example, to the light body mounting base, it is possible to easily incorporate the light body into a prescribed position of the light body mounting base by way of the projection part which functions as a guide and easily position the hook type connector arranged around the projection part with regard to the light body mounting base, and yet it is possible to connect the hook type connector both electrically and mechanically by hooking the same to the Light body mounting base, and thus it is possible to improve workability of the light body.

Still further, the light body structure has a projection part which is formed monolithically at a top part of the light body structure and a flat part which is formed around the projection part, and the connector is a hook type connector arranged in said flat part. By this, when mounting a light body, for example, to the light body mounting base, it is possible to easily incorporate the light body into a prescribed position of the light body mounting base by way of the projection part which functions as a guide and easily position the hook type connector arranged around the projection part with regard to the light body mounting base, and yet it is possible to connect the hook type connector both electrically and mechanically by hooking the same to the light body mounting base, and thus it is possible to improve workability of the light body. What is more, since the position to arrange the connector is a flat part, it is possible to easily arrange the connector.

Still further, the lamp socket has a tubular part which is formed monolithically with the light body structure with one end facing the main reflection plate and the other end opened, an end body which is fixed to the open part of the other end of the tubular part for closing the other end, and an electrically conductive structure which is mounted to the end body and positioned within the tubular part and to which a lamp is connected. By this, together with exclusion of a special insulation structure with regard to the connector enabled by making the light body structure for fixing the connector with a plastic material, it is possible to simplify the construction.

A light body mounting base according to the present invention provides a plastic base structure which is arranged to a fitting hole formed in a fitting face and has a frame part enabling fitting of a light body having a connector, a terminal block which is arranged to said base structure and enables connection of an electric power cable and a feed wire, and a connection means which is arranged to said base structure and connected electrically to said terminal block for receiving and electrically connecting and mechanically supporting the connector of said light body. By this, it is possible to connect the light body both electrically and mechanically by way of the connector, and by making the base structure with a plastic material, it is possible to exclude a special insulation structure with regard to the connection means, and thus it is possible to improve workability of the light body and simplify construction of the lamp mounting base.

Also, for the base structure, a plastic material having a specific gravity of below 2 and a thermal conductivity of at least 3 cal/cm$^3$ is used. By this, even with a plastic base structure, it is possible to improve heat dissipation of a lamp during lighting.

Further, for the base structure, a glass fiber reinforced plastic material having a specific gravity of below 2 and a thermal conductivity of at least 3 cal/cm$^3$ is used. By this, even with a plastic base structure, it is possible to improve heat dissipation of a lamp during lighting as well as improve both a rigidity and heat resistance.

Still further, the base structure has a bridge part which stands from the frame part, and the connection means has an annular part which is arranged in said bridge part and receives a top part of a light body. By this, when mounting the light body to the light body mounting base, it is possible to easily incorporate the light body into a prescribed position of the light body mounting base by receiving the top part of the light body into the annular part of the bridge part and easily position and connect the connector of the light body to the connection means of the bridge part, and thus it is possible to improve workability of the light body.

Still further, the base structure has a bridge part which stands from the frame part, and the connection means has an annular part which is arranged in said bridge part and forms a space for heat dissipation between the same and a top part of a light body. By this, when mounting the light body to the light body mounting base, it is possible to easily incorporate the light body into a prescribed position of the light body mounting base by receiving the top part of the light body into the annular part of the bridge part and easily position and connect the connector of the light body to the connection means of the bridge part, and thus it is possible to improve workability of the light body. What is more, since the space for heat dissipation is formed between the annular part and the top part of the light body, it is possible to radiate heat from the top part of the light body through the space and improve heat dissipation.

Still further, the base structure has a bridge part which stands from the frame part, and the connection means has an annular part which is arranged in said bridge part and receives a top part of a light body and a concave groove for fitting the connector of the light body. By this, when mounting the light body to the light body mounting base, it is possible to easily incorporate the light body into a prescribed position of the light body mounting base by receiving the top part of the light body into the annular part of the bridge part and easily position and connect the connector of the light body to the concave groove of the bridge part, and thus it is possible to improve workability of the light body.

Still further, the base structure has an engagement part which protrudes outward from the frame part and engages with a fitting face, a feed screw arranged in said frame part so as to allow operation from a fitting face side, and a fitting means which is arranged to move by operating the feed screw and has a stopper part which retreats toward a non-engagement position with regard to the fitting face by opposing elasticity by movement toward a prescribed position, develops by elasticity toward an engagement position with regard to the fitting face by movement toward a position off the prescribed position, and in cooperation with the engagement part, holds the fitting face. By this, by moving the stopper part to the prescribed position, the stopper part retreats to a non-engagement position with regard to the fitting face by opposing elasticity and the stopper part is not in the way when fitting the frame part to the fitting face, and yet, by moving the stopper part toward a position off the prescribed position after arranging the frame part, the stopper part develops by elasticity to an engagement position with regard to the fitting face, it is possible to improve workability.

Still further, the connection means and the terminal block are formed monolithically with the base structure. By this, construction can be simplified.

An embedded lighting equipment according to the present invention provide a plastic light body structure having a concave main reflection plate to which a light emitting part of a lamp is located oppositely, a lamp socket which is arranged in the light body structure for positioning the light emitting part of said lamp within said main reflection plate, and a light body mounting base comprising a light body having a connector which is fixed to said light body structure for supplying a lamp electric power to said lamp socket by electrical connection and for mechanically supporting the light body structure, a plastic base structure which is arranged in a fitting hole formed in a fitting face and had a frame part for fitting a light body having a connector, a terminal block which is arranged in the base structure for connecting an electric power cable and a feed wire, and a connection means which is arranged in said base structure and connected electrically to said terminal block for receiving, electrically connecting and mechanically supporting the connector of said light body. By this, it is possible to connect the light body both electrically and mechanically, for example, to a light body mounting base for mounting the light body, and yet by making the light body structure for fixing the connector with a plastic material, it is possible to exclude a special insulation structure with regard to the connector, and thus it is possible to improve workability of the light body and simplify the light body construction. What is more, it is possible to connect the light body both electrically and mechanically to the light body mounting base by way of the connector, and yet by making the base structure with a plastic material, it is possible to exclude a special insulation structure with regard to the connection means, and thus it is possible to improve workability of the light body and simplify the light body construction.

Further, the base structure has a bridge part which stands from the frame part, the connection means is a hook type connection construction which is arranged in said bridge part, the connector is a hook type connector which is connected electrically and mechanically to said connection means, and the lamp socket protrudes outward from a position, in a middle part of the light body structure and within a rotation range of the light body structure, where the lamp socket does not interfere with said bridge part. By this, when mounting the light body to the light body mounting base, it is possible to easily connect the light body both electrically and mechanically by engaging the hook type connector of the light body to the connection means of hook type connection construction of the bridge part, and thus it is possible to improve workability of the light body. What is more, since the lamp socket protrudes from a position not interfering with the bridge part in a middle part of the light body structure and within a rotation range of the light body structure, it is possible to compose the light body shallower in shape compared with a case in which the light body is arranged at the top part of the light body structure and enable a hook connection of the hook type connector to the connection means by a rotation of the light body structure.

The above, and other objects, features and advantages of the present invention will become apparent from the following description read in conjunction with the accompanying drawings, in which like reference numerals designate the same elements.

BRIEF DESCRIPTION OF DRAWINGS

FIG. 1 is an exploded perspective view of a light body mounting base and a light body of a ceiling fixture according to a first embodiment of the present invention.

DETAILED DESCRIPTION OF THE PREFERRED EMBODIMENTS

Figure 8:
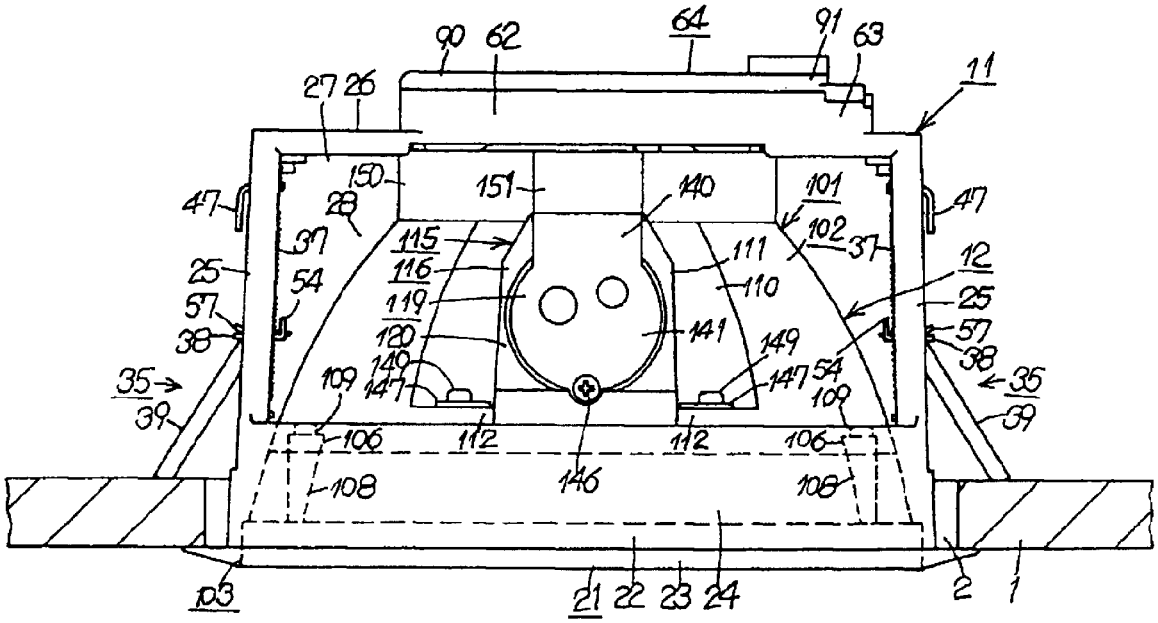
FIG. 8 is a side view of the ceiling fixture during installation.
Figure 9:
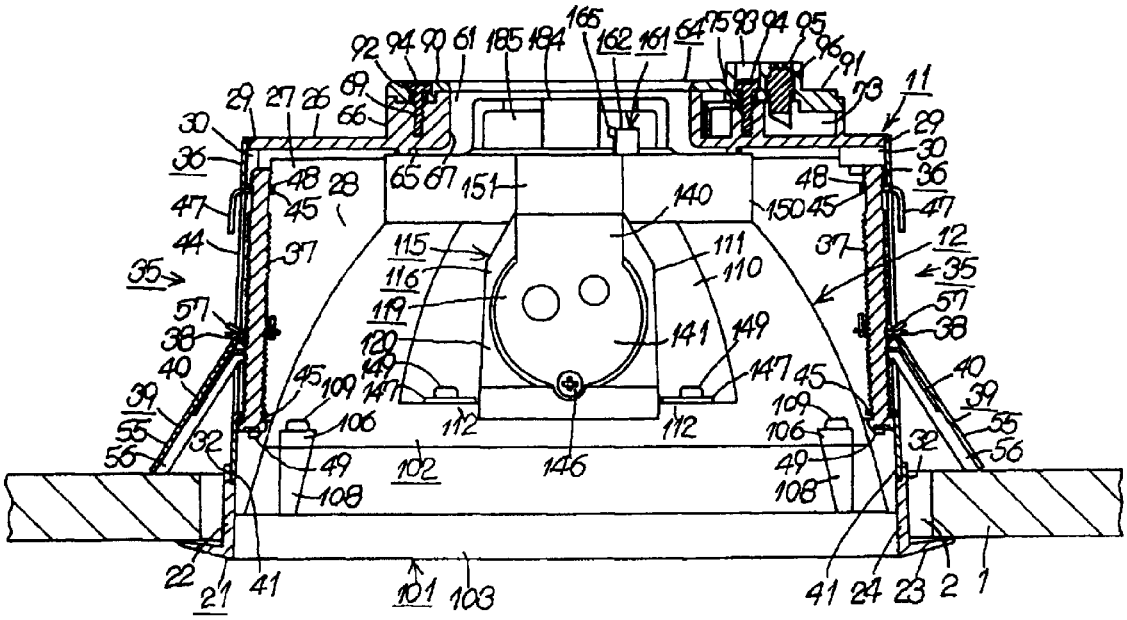
FIG. 9 is a side view corresponding to FIG. 8 showing a sectional view of the light body mounting base shown in FIG. 8.

Referring to FIGS. 8 and 9, a ceiling board 1 is used as a fitting face for mounting the ceiling fixture. A hole 2, preferably circular, in the ceiling board 1 permits embedding the ceiling fixture in the ceiling board 1. Before installation, an electric power cable (not illustrated) to be arranged in a ceiling space above the ceiling board 1 and a feed wire (not illustrated) for feeding electric power to a lighting device, are separately drawn through hole 2.

Referring to FIG. 1, the ceiling fixture is composed of a light body mounting base 11 and a light body 12. The light body mounting base 11 is embedded into the fitting hole 2 of the ceiling board 1. The light body 12 is mounted to the light body mounting base 11 so as to freely inserted and removed.

Figure 2:
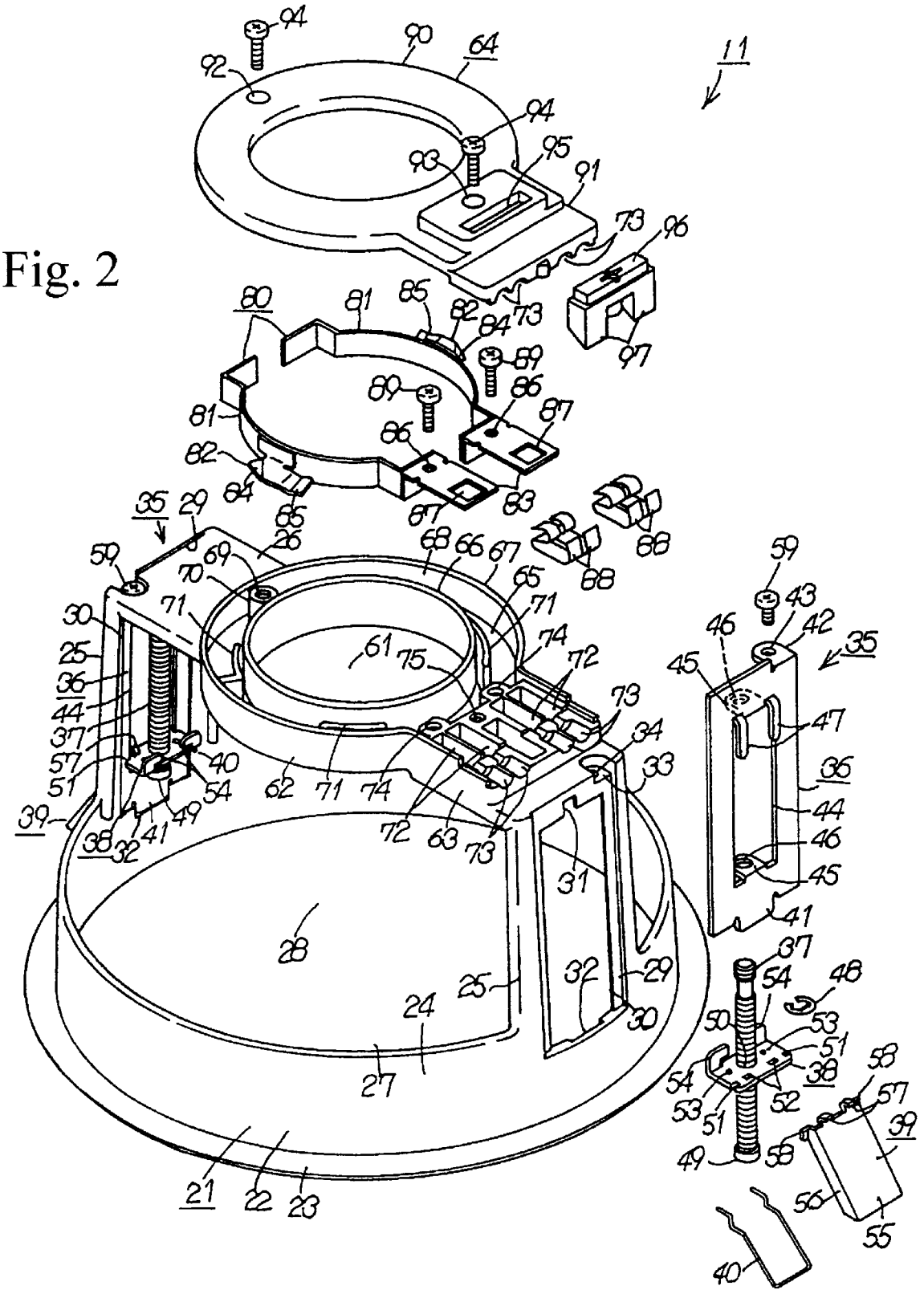
FIG. 2 is a perspective view of the light body mounting base in an exploded condition.
Figure 3:
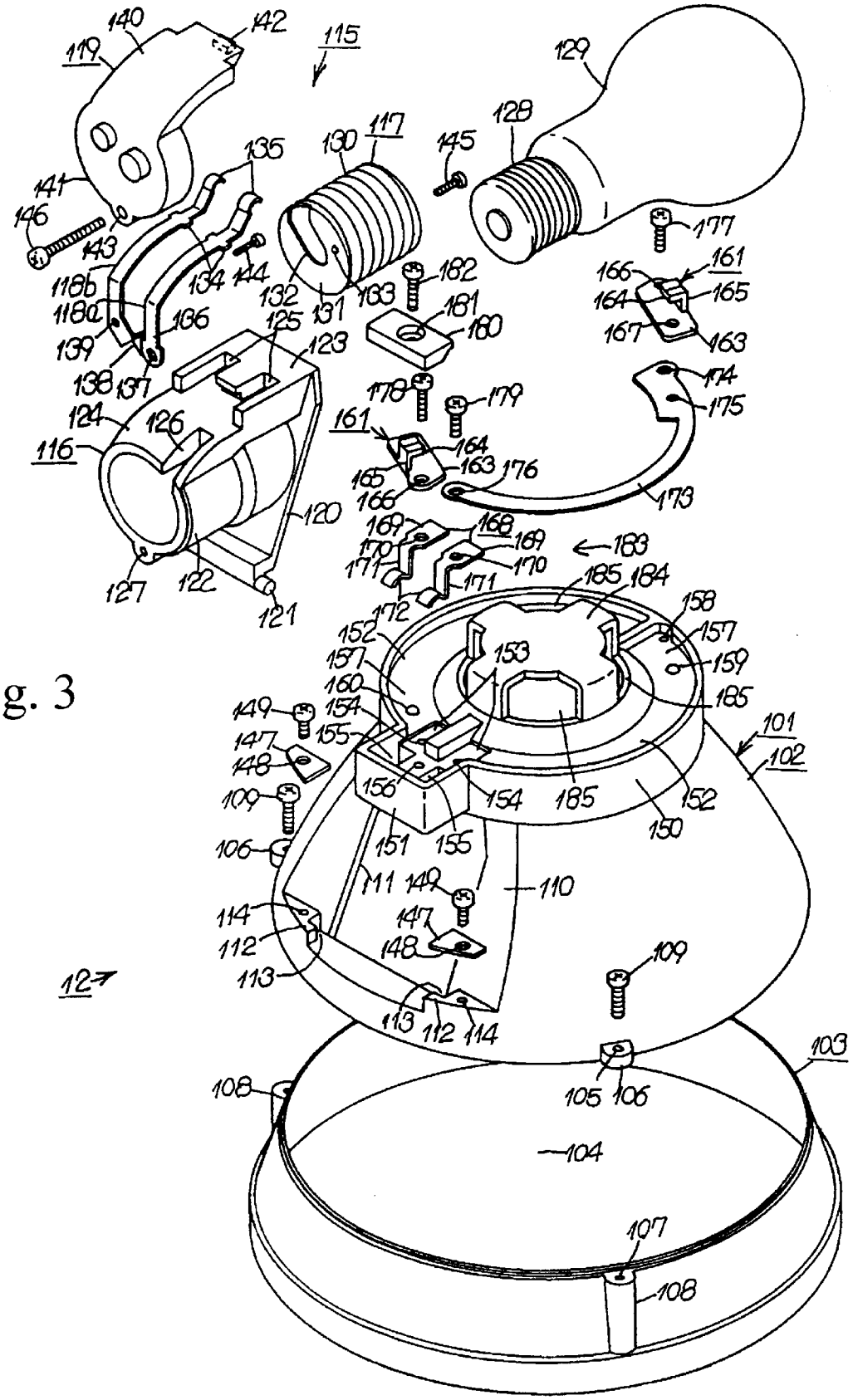
FIG. 3 is a perspective view of the light body in an exploded condition.
Figure 4:
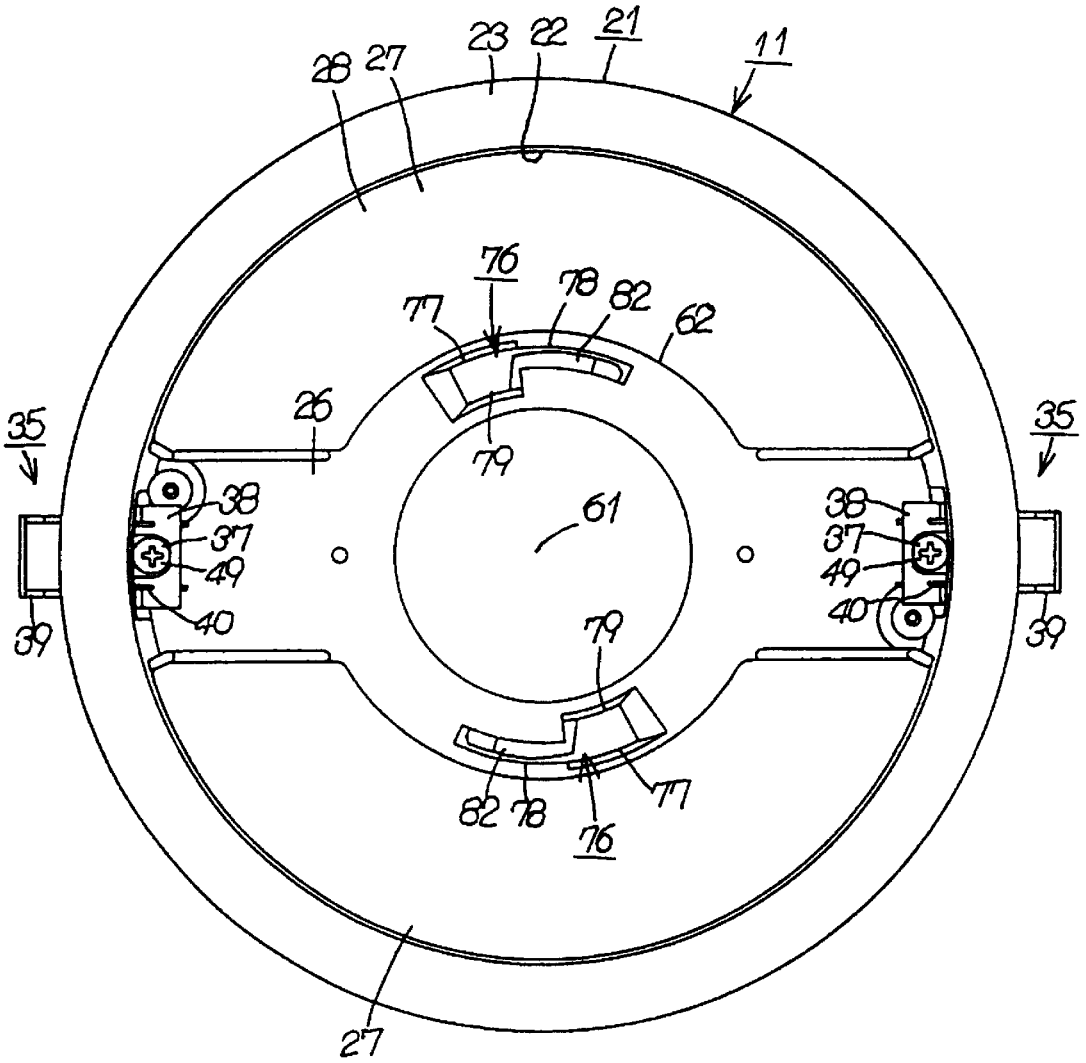
FIG. 4 is a bottom view of the light body mounting base.

Referring now to FIGS. 2 and 4, the light body mounting base 11 has a base structure 21, preferably made of an insulating synthetic resin. More preferably, the synthetic resin has a specific gravity of below 2 and at least 3 cal/cm$^3$ in heat conductivity. Alternatively, the base structure 21 may be a glass fiber reinforced plastic material having a specific gravity of below 2 and a thermal conductivity of at least 3 cal/cm$^3$.

A frame part 22 of the base structure 21 is inserted and embedded into the fitting hole 1. A ring-shaped flange part 23 protrudes in an outer diameter direction from a lower edge part of the frame part 22. The ring-shaped flange part 23 is an engagement part that contacts a surface (a lower face) of the ceiling board 1, surrounding the hole 2. A cylindrical part 24 is formed in a lower side of the frame part 22. Cylindrical part 24 may have other shapes than a cylinder such as, for example, a frustum of a cone. Rise parts 25 extend upward from symmetric positions of the cylindrical part 24. A stand part 26 bridges the gap between upper ends of both rise parts 25. An open part 27 is formed between cylindrical part 24, rise parts 25 and stand part 26. A light body insert part 28 in frame 22 opens downward. The light body 12 is inserted into light body insert part 28.

A concave part 29 is formed in an outer face of each rise part 25. Inside the concave part 29, there is formed a fitting port 30. A notch part 31 is formed in an upper center of the fitting port 30. A grooved part 32 is formed in a lower center of the fitting port 30. A concave-shaped step part 33 is disposed at an upper right of the concave part 29. A fitting hole 34 is formed in the step part 33.

A stopper unit 35 is fitted to each rise part 25. The stopper unit 35 is a fitting means. The stopper unit 35 is formed with a support plate 36, a feed screw 37, a movement body 38, a stopper body 39 as a stopper part, and a spring 40 as an energizing means.

The support plate 36 is sized to fit in the concave part 29. A lower part of support plate 36 is formed into a protruding hook tip part 41. Hook tip part 41 fits into the groove part 32. An upper right part of support plate 36 includes a fitting tip part 42 which is bent toward an inside face side (a base structure 21 side). Fitting tip part 42 is assembled into the step part 33. An insert hole 43 is formed in the fitting tip part 42.

An opening part 44 is formed in a center of the support plate 36. Support tip parts 45 depend from upper and lower edges of the opening part 44. Support parts 45 are bent toward an inside face. A support hole 46 is disposed in each support tip part 45. A pair of guide tip parts 47 are formed at each side of the support tip part 45 in the upper edge of the opening part 44. The guide tip parts 47 first protrude outward from an outer face side of opening part 44, and then are bent downward generally parallel to support plate 36. Additionally, as described in detail later, an upper end side (an end part in an embodiment direction) where the guide tip part 47 of the support plate 36 is formed, provides a space into which the stopper body 39 may retreat toward a non-engagement position with regard to the ceiling board 1.

The upper and lower ends of feed screw 37 pass through the upper and lower support holes 46 of upper and lower support tip parts 45 of the support plate 36 so as to freely rotate. The feed screw 37 is retained against slipping downward by a C-ring 48 which is snapped onto an upper end part of the feed screw 37. An engagement part 49 at a lower end part of the feed screw permits rotation thereof by a conventional tool, such as a screw driver, while preventing the feed screw 37 from moving upward.

A threaded screw hole 50 is formed in the center of the movement body 38. The feed screw 37 is threaded through the screw hole 50. Sliding grooves 51 are formed at both side edges of the movement body 38. Sliding grooves 51 are fitted onto the inner edges of the side edge parts of the opening part 44 of the support plate 36 so as to freely slide. A pair of engagement holes 52 are formed near an outer edge part of the movement body 38. A through hole 53 is formed at each side of the screw hole 50. A pair of hook tip parts 54 rise upward from at an inside edge part of the movement body 38. The movement body 38 is moved in a vertical direction (an embodiment direction) by a rotational movement of the feed screw 37.

The stopper body 39 has side plate parts 56 which are bend toward an inside face from the stopper plate part 55. Both side edge parts of the stopper plate part 55 have a width permitting insertion through the opening part 44 of the support plate 36. A pair of near-L-shaped stopper tip parts 57 at an upper end of the stopper plate part 55 are inserted from below into the engagement holes 52 of the movement body 38. The stopper body 38 is allowed to swing between a non-engagement position where the stopper body 38 is nearly parallel to support plate 36 side and an engagement position where the stopper body 38 extends aslant sideways, supported by the engagement tip part 57. A stopper 58 protrudes sideways from an upper end of each side plate part 56. When the stopper body 39 swings toward an engagement position, motion of the stopper body 39 is restricted at the prescribed engagement position by the stopper 58 touching an inside face side of the support plate 36.

The spring 40 is composed of a spring wire formed in a nearly U shape. The two ends of the spring 40 are inserted from below into through holes 53 of the movement body 38 and hooked under hook tip parts 54 of movement body 38. A middle part of the spring 40 contacts an inside face side of the stopper body 39. Thus the stopper body 39 is resiliently urged toward its outward engagement position.

By assembling the stopper body 39 and the spring 40 into the movement body 38, threading the feed screw 37, passing the stopper body 39 from an inside face side of the support plate 36 through to the opening part 44, and fitting the sliding grooves 51 of the movement body 38 onto the inner edges of the opening part 44 of the support plate 36, and, by threading the feed screw 37 at its upper and lower ends through the support tip parts 45 of the support plate 36 and fixing the feed screw 37 with the C-ring 48, the stopper unit 35 is assembled. After assembling the stopper unit 35, the support plate 36 is fitted to the concave part 29 with the hook tip part 41 of the support plate 36 in the groove 32 of the base structure 21 and fitting the fitting tip part $^{4}$2 to the step part 33. Then a fitting screw 59 is threaded into the fitting hole 34 of the step part 33 through the insert hole 43 of the fitting tip part 42, and thus the assembled stopper unit 35 is fixed to the rise part 25 of the base structure 21.

Also, in the stand part 26 of the base structure 21, there is formed in a center part a guide hole part 61 which is opened in a vertical direction. Around the guide hole part 61, there is formed an annular part 62. At one end side of the annular part 62, there is monolithically formed a terminal block 63. A cover 64 is mounted on the upper faces of these annular part 62 and terminal block 63. The cover 64 is removable to permit access to the terminal block 63.

The annular part 62 has an inner periphery part 66 and an outer periphery part 67 which rise from inner and outer peripheral edges of a bottom face part 65. The space between the inner and outer periphery parts 66, 67 forms an upward opening terminal storage groove 68. A boss 70 is disposed in a side of the terminal storage groove 68 that is opposite to the location of terminal block 63. The boss 70 includes a fitting hole 69 therein to engage a screw 94 securing the cover 64 in place. A plurality of terminal holder tips 71 extend upward within the terminal storage groove 68 of the stand part 26.

In the terminal block 63, there are formed a parallel pair of concave terminal storage parts 72. Lower sides of electric wire insert holes 73 are respectively formed at an outer end side of terminal storage parts 72. In each terminal storage part 72, there is formed a fitting hole 74 adjacent annular part 62. Between the sets of terminal storage parts 72, there is formed a fitting hole 75.

Figure 5:
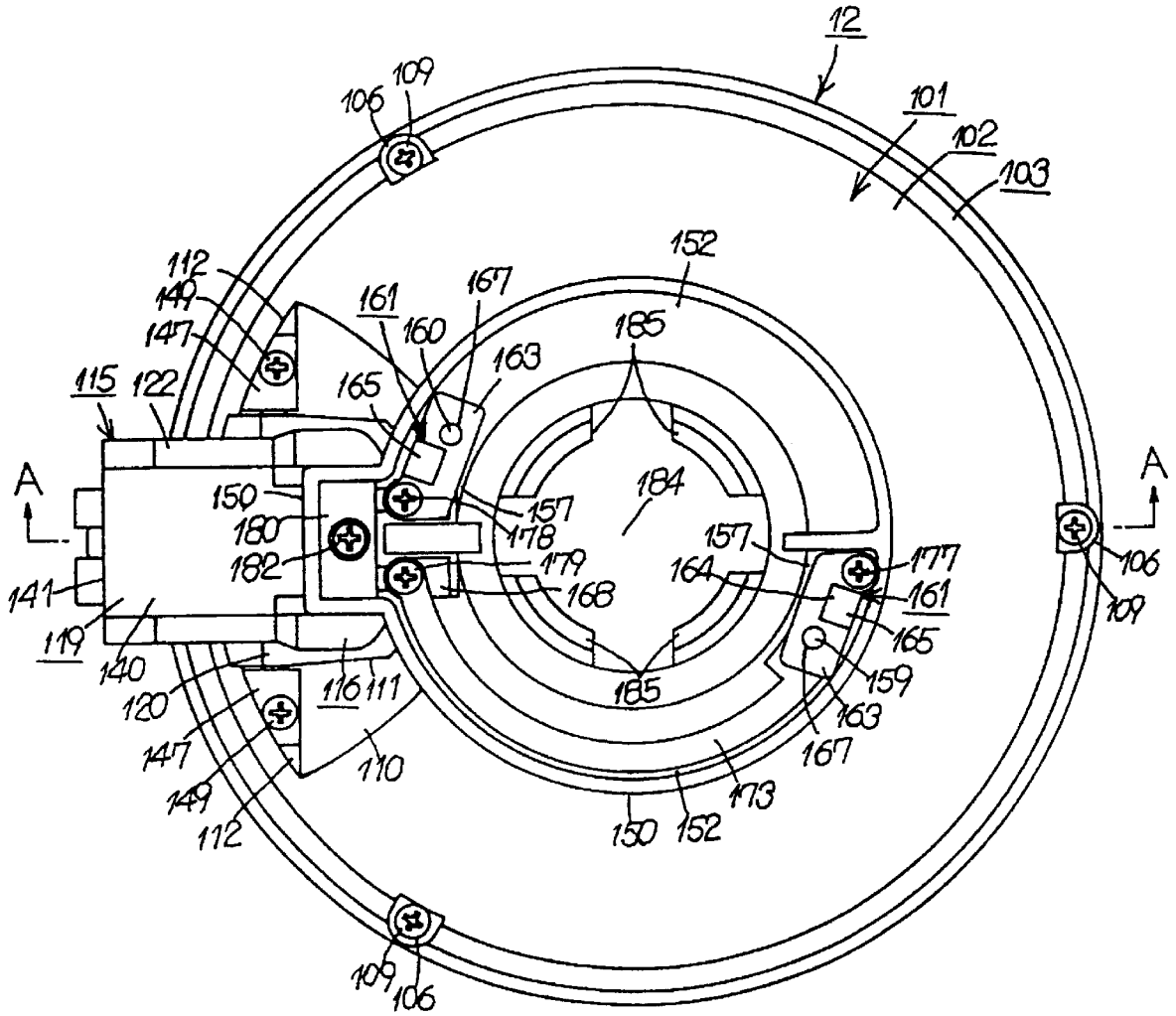
FIG. 5 is a top view of the light body.
Figure 6:
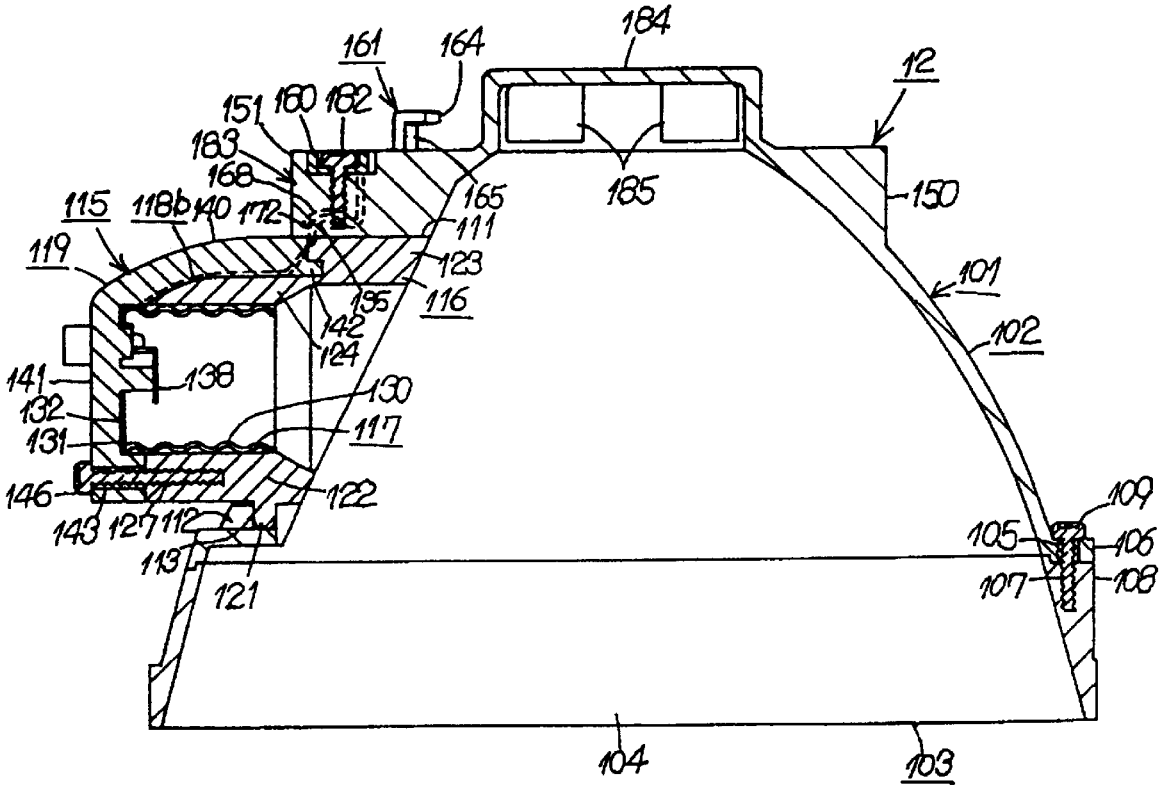
FIG. 6 is a cross section taken along A—A in FIG. 5.
Figure 7:
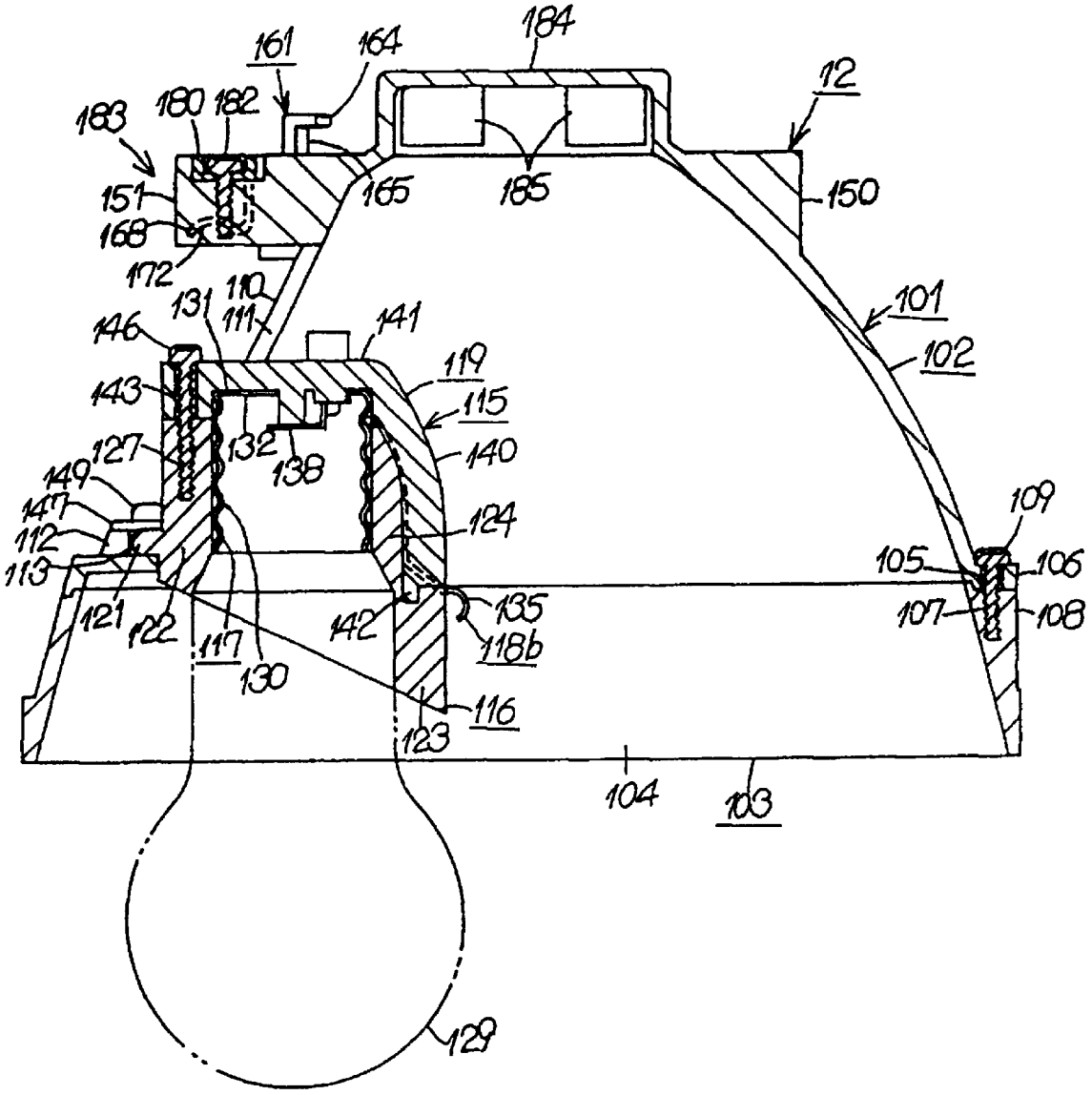
FIG. 7 is a sectional view corresponding to FIG. 6 in which a lamp socket shown in FIG. 6 is rotated to a lamp replacement/removal position.

In the bottom face 65 of the ring-shaped part 62 (FIG. 4), there is arranged monolithically a connection means 76. The connection means 76 has an engagement hole 77 shaped as a concave groove formed symmetrically at a symmetric position in the direction crossing both end directions of the stand part 26. In the engagement hole 77, there is formed a groove hole part 78 which is formed closer to an outer periphery side of the bottom face part 65. At an end part in a counterclockwise direction viewed from a bottom face direction of the groove hole part 78 (under a condition shown in FIG. 5), there is formed an insert hole part 79. With these groove hole parts 78 and the insert hole parts 79, the engagement holes 77 are nearly L-shaped.

In the terminal storage groove 68 of the annular part 62, a pair of terminal bodies 80 are arranged at symmetric positions in a direction crossing the end directions of the stand part 26. Each terminal body 80 has an electrically conductive plate 81 which is held between the inner periphery part 66 and the terminal holder tip 71. A hook type power supply terminal 82 is attached by spot welding to an intermediate outer face of the electrically conductive plate 81. A terminal plate 83 is spot-welded to an end part facing the terminal block 63 of the electrically conductive plate 81.

Each hook type power supply terminal 82 is arranged on an edge part of an inner periphery side of the groove hole part 78 coaxially centering around the guide hole part 61, and at one end facing the insert hole part 79, there is formed a stopper projection part 84, and at the other end, there is formed an engagement concave 85 which is formed in an angle concave shape.

Each terminal plate 83 is arranged on the terminal storage part 72 of its respective terminal block 63. Corresponding to a position of the fitting hole 74 of the terminal block 63, there is formed an insert hole 86. A window hole 87 is formed on a top end side each terminal plate 83. In each terminal storage part 72 of the terminal block 63, there is arranged a locking terminal 88 which is assembled with the terminal plate 83.

After inserting the locking terminals 88 into each terminal storage part 72 of the terminal block 63, each terminal body 80 is mounted to the stand part 26 by inserting the electrically conductive plate 81 and hook type power supply terminal 82 of each terminal body 80 into the terminal storage groove 68 of the annular part 62, and threading the fitting screw 89 into the fitting hole 74 of the terminal block 63 by way of the insert hole 86 of the terminal plate 83 by adjusting the terminal plate 83 of each terminal body 80 onto the terminal block 63.

In the cover 64, there are formed an annular cover part 90 which covers an upper face of the annular part 62 and a terminal block cover part 91 which covers an upper face of the terminal block 63. Fitting holes 92 and 93 are formed in cover 64 at positions corresponding to the positions of the fitting hole 69 of the annular part 62 and the fitting hole 75 of the terminal block 63. By threading fitting screws 94 into fitting holes 69 and 75 by way of fitting holes 92 and 93, the cover 64 is mounted to the stand part 26.

In the terminal block cover part 91, there is formed an upper side of each electric wire insert hole 73 at a lower face of a top end side. A window hole 95 is formed in a center of the terminal block cover part 91. Inside the window hole 95, there is arranged a release button 96. In the release button 96, there is formed a thrust part 97 which is fitted on locking terminals 88 by passing through the window hole 87 of the terminal plate 83.

By inserting stripped tips of paired core wires of unillustrated electric power cables and feed wires into electric wire insert holes 73 of the terminal block 63, the core wires are thrust between the terminal plate 83 and the locking terminal 88 and prevented from slipping off under an electrically connected condition.

Additionally, the connection means 76 arranged in the base structure 21 electrically connects the light body 12 and mechanically supports it at the same time. To enable electric connection, the connection means 76 has the terminal body 80. To enable mechanical support, the connection means 76 has the stand part 26, the guide hole part 61, the annular part 62 and the engagement hole 77.

Referring now to FIGS. 3, 5, 6 and 7, the light body 12 has a light body structure 101 that includes a reflection body 102 as a main reflection plate and a flange body 103 as a light control body. The flange body 103 is mounted at a lower part of the reflection body 102. In a lower face of flange body 103 there is formed an irradiation opening 104.

The reflection body 102 is made of an insulating synthetic resin. Preferably, reflection body 102 is a plastic material having a specific gravity of below 2 and heat conductivity of at least 3 cal/cm$^3$, or a glass fiber reinforced plastic material having a specific gravity of below 2 and heat conductivity of at least cal/cm$^3$. The reflection body 102 is formed in a conical or paraboloid shape having an expanding lower end side. In an outer face of the lower end, a plurality of fitting tip parts 106 having insert holes 105 extend outward from reflection body 102.

The flange body 103 is made, for example, of a synthetic resin like that used for the reflection body 102 or a metal (a resin embodiment is illustrated). Flange body 103 is in a ring shape matching the shape of a lower end of the reflection body 102. An outer face of flange body includes a plurality of boss parts 108 each having a fitting hole 107.

Thus, the reflection body 102 and the flange body 103 are linked by passing the fitting screw 109 through the insert hole 105 of the reflection body 102 and threading it into the fitting hole 107 of the flange body 103 side.

In a middle part of a side face of the reflection body 102, there is formed a socket fitting concave part 110. The socket fitting concave part 110 includes an opening part 111. At lower parts of both sides of the socket fitting concave part 110, there are formed mounting base parts 112. In each mounting base part 112, there is formed a bearing groove part 113 which opens upward. In an upper face of each mounting base part 112, there is formed a fitting hole 114.

To the socket fitting concave part 110 of the reflection body 102, a lamp socket 115 is mounted. The lamp socket 115 is formed with a socket holder 116, a bracket 117, an electrically conductive structure having a pair of socket terminals 118*a* and 118*b*, and a socket cover 119 as an end body.

The socket holder 116 is made of an insulating synthetic resin. At lower ends of both side of a support plate part 120 a shaft part 121 extends sideways for rotationally free installation in the bearing groove parts 113 of the reflection body 102. In an outer face of the support plate part 120, a socket cylinder part 122 extends outward. An inside of the socket cylinder part 122 opens in an axial direction. In an upper face of the socket cylinder part 122, there is formed on the support plate part 120 a side a terminal hold part 123. From the terminal hold part 123 to an outer end of the socket cylinder part 122, there is formed and protruded a terminal engagement part 124, which is gently curved. In the terminal hold part 123, there are formed a pair of terminal engagement grooves 125 for fitting the pair of socket terminals 118*a* and 1118*b*. In the terminal engagement part 124, there is formed a through part 126 which is connected through to an inside of the socket cylinder part 122 aligned with one terminal engagement groove 125. At a lower end part of the socket cylinder part 122, there is formed a fitting hole 127.

The bracket 117 forming a part of the electrically conductive structure enables a lamp 129 having base 128, such as the Edison type E17, to be connected. The bracket 117 has a connection cylinder part 130 which is formed in a cylinder shape with spiral threads. At one end of the connection cylinder part 130, there is formed an end face plate part 131. From a center part to part of a periphery of the end face plate part 131, there is formed a notch part 132. Near the notch part 132, there is formed an insert hole 133.

A pair of socket terminals 118*a* and 118*b* forming a part of the electrically conductive structure at their middle parts are arranged and fitted onto the terminal engagement part 124. Near one end of each socket terminal 118*a*, 118*b*, there is formed a holding projection part 134 which is held by the terminal engagement groove 125. At one end of socket terminals 118*a*, 118*b* there is formed an arc-shaped engagement part 135 which protrudes upward from the terminal engagement part 125. In one socket terminal 118*a*, there is formed a connection tip part 136 which is inserted through the through part 126 into the socket cylinder part 122 and connected to the bracket 117. In the connection tip part 136, there is formed an insert hole 137. At the other end of the other socket terminal 118*b*, there is formed a contact tip part 138 which is inserted through an outer end part of the socket cylinder part 122 and arranged in the notch part 132 of the bracket 117 under a non-contact condition. At a base end part of the contact part 138, there is formed an insert hole 139.

The socket cover 119 is made of an insulating synthetic resin. The socket cover 119 has a terminal cover part 140 which covers an upper face of the terminal engagement part 124 and an end plate part 141 which covers an end face of the socket cylinder part. At a top end of the terminal cover part 140, a projection part 142 protrudes for fitting with the terminal hold part 123. On a lower side of the end plate part 141, there is formed an insert hole 143. In an inner face of the end plate part 141, though not illustrated in the drawing, there are formed fitting holes aligned with positions of insert holes 137 and 139 of socket terminals 118*a* and 118*b*.

Thus, to assemble the lamp socket 115, a fitting screw 144 which is inserted through the insert hole 139 of the other socket terminal 118*b* is threaded and fitted to an inner face of the socket cover 119 and a fitting screw 145 which is inserted through the inner hole 137 of one socket terminal 118*a* is threaded and fitted to an inner face of the socket cover 119, and thereby, the bracket 117 and one socket terminal 118*a* are connected electrically. The contact tip part 138 of the other socket terminal 118*b* is fitted to the notch part 132 of the bracket 117 under a non-contact condition. The bracket 117 which is mounted to the socket cover 119 is inserted from an outside into the socket cylinder part 122. The holding projection part 134 of each of the socket terminals 118*a* and 118*b* is fitted to its respective terminal engagement groove 125. The projection part 142 of the socket cover 119 is fitted to the terminal hold part 123. A fitting screw 146 is passed through the insert hole 143 of the socket cover 119 and threaded into the fitting hole 127 of the socket cylinder part 122. Additionally, the sequence of assembling the lamp socket 115 is not limited to the procedure described above.

And, to mount the lamp socket 115 assembled like this to the reflection body 102, the shaft part 121 at both lower ends of the socket holder 116 are fitted from above into their respective bearing groove parts 113 at both lower ends of the socket fitting concave 110. A thrust plate 147 for closing an upper face of the bearing groove part 113 is installed on the mounting base part 112. A fitting screw 149 is passed through an insert hole 148 of the thrust plate 147 threaded into the fitting hole 114 of the mounting base part 112.

Thus, the lamp socket 115, mounted to the reflection body 102, is supported so as to freely rotate between a horizontal lamp lighting position in which a direction of lamp connection is nearly parallel with the irradiation opening 104 of the reflection body 102 and a vertical lamp replacement/removal position in which the direction of lamp connection is nearly vertical to the irradiation opening 104. Additionally, the lamp lighting position of the lamp socket 115 is restricted by an upper face of the terminal hold part 123 touching an upper edge of the opening part 111 and held by contact with an engagement terminal 168 to be mentioned later.

In an upper part of the reflection body 102, there is formed an annular base part 150. In the base part 150, there is formed a projection part 151 which protrudes above the socket fitting concave 110. In an upper face of the base part 150, there are formed in blocks a pair of flat curved parts 152, one on each side of a center line passing through the projection part 151. At an end part facing the projection part 151 of each curved part 152, there is formed a concave-shaped terminal engagement part 153. In each terminal engagement part 153, there is formed a fitting hole 154 on an inside diameter side. On an outside diameter side of each terminal engagement part 153, there is formed a space 155 which passes through in a vertical direction. In an upper face of a partition part between the spaces 155, there is formed a fitting hole 156.

At an end part of the curved part 152 opposite from the projection part 151 and in a symmetrical position at an end part of the other curved part 152, there are respectively formed terminal fitting parts 157. In one terminal fitting part 157, there are formed a fitting hole 158 and a projection 159. In the other terminal fitting part 157, there is formed a projection part 160.

To each terminal fitting part 157, a pair of hook type power receiving terminals 161, as connectors (hook type connectors), are mounted concentrically around a guide projection part 184 which is mentioned later. The hook type power receiving terminal 161 is made of a conductive metal and has a fitting part 163. From an outer edge part of the fitting part 163, there is formed and raised a near-L-shaped hook tip part 165 having a hook pawl part 164 which is bent inward. In the fitting part 163, there are formed an insert hole 166 and an engagement hole 167. The hook pawl part 164 is formed with an angle shape protruding toward a lower face side.

To each terminal engagement part 153, the engagement terminal 168 is attached. The engagement terminal 168 has a fitting tip part 169 which is fitted onto the terminal engagement part 153. In the fitting tip part 169, there is formed a fitting hole 170. At an outer end of the fitting tip part 169, there is formed a connection tip part 171 which is bent downward and entered into the space 155, and at a top end of the connection tip part 171, there is formed an arc-shaped engagement part 172 which enables engagement with the engagement part 135 of socket terminals 118*a* and 118*b*.

To one curved part 152, an electrically conductive plate 173 for connecting one hook type power receiving terminal 161 and the engagement terminal 168 is arranged. The electrically conductive plate 173 is formed in an arch shape along the curved part 152. At one end of the plate 173, which is connected with the hook type power receiving terminal 161, there are formed an insert hole 174 and an engagement hole 175. At the other end which is connected to the engagement terminal 168, there is formed an insert hole 176.

Thus, to assemble terminal parts to the base part 150, a pair of engagement terminals 168 are fitted to terminal engagement parts 153, the engagement hole 175 of the electrically conductive plate 173 is fitted to the projection part 159 of one curved part 152 and the electrically conductive plate 173 is fitted to one curved part 152. The engagement hole 167 of one hook type power receiving terminal 161 is fitted to the projection part 159 which protrudes from the engagement hole 175 upward. The hook type power receiving terminal 161 is mounted onto the electrically conductive plate 173. The engagement hole 167 of the other hook type power receiving terminal 161 is fitted to the projection part 159 of the other curved part 152. The hook type power receiving terminal 161 is fitted to the other curved part 152. A fitting screw 177 is passed through the insert hole 167 of one hook type power receiving terminal 161 and the insert hole 174 of the electrically conductive plate 173 and threaded and tightened into the fitting hole 158 of one curved part 152. A fitting screw 178 passes through the insert hole 166 of the other hook type power receiving terminal 161 and the fitting hole 170 of the other engagement terminal 168 is threaded and tightened in the fitting hole 154 of the terminal engagement part 153. A fitting screw 179 passes through the insert hole 176 of the electrically conductive plate 173 and the fitting hole 170 of one engagement terminal 168 is threaded and tightened in the fitting hole 154 of the terminal engagement part 153. The terminal cover 180 is fitted to the projection part 151. A fitting screw 182 is inserted through an insert hole 181 of the terminal cover 180 and threaded into the fitting hole 156 of the projection part 151.

By incorporating terminal parts into the base part 150, one hook type power receiving terminal 161 and one engagement terminal 168 are connected electrically by way of the electrically conductive plate 173, and the other hook type power receiving terminal 161 and the other engagement terminal 168 come into direct contact and are electrically connected.

When the lamp socket 115 is in the lamp lighting position, socket terminals 118*a* and 118*b* are engaged with the engagement terminal 168 and are electrically connected and held. When the lamp socket 115 is rotated to the lamp replacement/removal position, socket terminals 118*a* and 118*b* are disconnected from the engagement terminal 168 and the electrical connection is broken. Therefore, an electrical connection means 183 is formed with the socket terminals 118*a* and 118*b*.

At a top part of the reflection body 102, there is formed a guide projection part 184 protruding upward. On a side part of the guide projection part 184, there is formed a plurality of vent holes 185.

Inner faces of the reflection body 102 and the flange body 103 may be mirror or white faced. Alternatively, the inner face of the flange body 103 may be blackened.

Referring now to FIG. 8 and FIG. 9, to install a ceiling fixture, an electric power cable, and feed wires are drawn out through the fitting hole 2 which is previously formed in the ceiling board 1. The stripped ends of the wires are inserted separately into electric wire insert holes 73 of the terminal block 63 of the light body mounting base 11 of the base and connected.

The frame part 22 of the light body mounting base 11 is inserted from below and push upward through fitting hole 2 until flange 23 contacts the outer surface of the ceiling board 1 around the fitting hole 2. For this purpose, the feed screw 37 is rotated to move the stopper body 39 upward until the lower ends of the stopper bodies 39 are above the upper surface of the ceiling board 1. However, the stopper body 39 is left unengaged with the guide tip part 47 located above, namely the stopper body 39 is left protruding toward an engagement position beside the frame part 22.

When the frame part 22 of the light body mounting base 11 is inserted into the fitting hole 2, each stopper body 39 which protrudes from the frame part 22 touches an inner rim of the fitting hole 2. This urges the stopper bodies 39 inward, against the urging of the springs 40.

When a lower end of each stopper body 39 passes the upper end of the fitting hole 2, the stopper body 39 which has been pushed inward is then urged outward by the spring 40 into the engagement position beside the frame part 22. Hence, even when pushing up of the light body mounting base 11 is stopped, the two stopper bodies 39 engage the upper surface of the ceiling board 1 to temporarily retain the light body mounting base 11 in ceiling board 1. Thus the installer can remove hands from the light body mounting base 11.

Through the light body insert part 28 inside the light body mounting base 11, the feed screw 37 is rotated by a tool, such as a screw driver, fitted on the engagement part 49 which faces below the feed screw 37. The stopper body 39 is lowered correlatively in relation to the light body mounting base 11. That is, the light body mounting base 11 is raised in relation to the stopper body 39 which touches the ceiling board 1. By this, the flange part 23 raised into contact with the ceiling board 1. The ceiling board 1 is clamped between the stopper body 39 and the flange part 23, and the light body mounting base 11 is thereby fixed to the ceiling board 1.

Next, the light body 12 is inserted from below into the light body insert part 28 of the light body mounting base 11 and pushed upward. In this instance, a direction of the light body 12 to the light body mounting base 11 is a direction in which the lamp socket 115 of the light body 12 agrees with the open part 27 of the light body mounting base 11. That is, a direction in which the pair of hook type power receiving terminals 161 of the light body 12 and the hook type power supply terminal 82 of the light body mounting base 11 are aligned. Also, when the lamp socket 115 is rotated to a vertical lamp replacement/removal position in which it is nearly vertical to the irradiation opening 104, the lamp socket 115 does not protrude outside the light body 12. Therefore, it is possible to insert the light body 12, as it is in a horizontal position, from under into the light body insert part 28 of the light body mounting base 11.

When inserting the light body 12 into the light body insert part 28 of the light body mounting base 11 with the lamp socket 115 in the lamp lighting position in which it is horizontal and nearly in parallel with the irradiation opening 104, the light body 12 is inserted into the light body insert part 28 of the light body mounting base 11 with a top end side which protrudes aside of the lamp socket 115 faced upward, rotated to a horizontal position with the top end side of the lamp socket 115 facing the open part 27 of the light body mounting base 11, and then the light body 12, as it is in the horizontal position, is inserted from below into the light body insert part 28 of the light body mounting base 11.

When the light body 12 is inserted to a rear side of the light body insert part 28 of the light body mounting base 11, the guide projection part 184 which protrudes from a top part of the light body 12, is fitted to the guide hole part 61 of the ring-shaped part 62 of the light body mounting base 11. Thus the pair of hook type power receiving terminals 161 of the light body 12 and the pair of hook type power supply terminals 82 of the light body mounting base 11 are moved together.

Further, the pair of hook type power receiving terminals 161 of the light body 12 are fitted to the pair of hook type power supply terminals 82 of the light body mounting base 11. That is, first each hook type power receiving terminal 161 is inserted inside the annular part 62 through the insert hole part 79 of its engagement hole 77, and the hook pawl part 164 at an upper end of each hook type power receiving terminal 161 is moved above the stopper projection part 84 of each hook type power supply terminal 82. In this inserted condition, the light body 12 is rotated clockwise, viewed from a bottom face, to pass the hook pawl part 164 of each hook type power receiving terminal 161 above the stopper projection part 84 of each hook type power supply terminal 82 and move the hook tip part 165 of each hook type power receiving terminal 161 to the groove hole part 78 of each engagement hole 77. Rotation of the light body 12 is restricted by the hook tip part 165 of each hook type power receiving terminal 161 touching an end part of the groove hole part 78 of each engagement hole 77. By canceling pushing up of the light body 12, the hook pawl 164 of each hook type power receiving terminal 161 contacts the engagement concave part 85 of each hook type power supply terminal 82 and pressed by a weight of the light body. Thus, by contact between the hook type power supply terminal 82 and the hook type power receiving terminal 161, both the mechanical stopping and electrical connection of the light body mounting base 11 and the light body 11 are done at the same time.

When the light body 12 is mounted to the light body mounting base 11 by rotating the lamp socket 115 from the lamp replacement/removal position, the lamp socket 115 is rotated to the lamp lighting position. By rotating the lamp socket 115 to the lamp lighting position, socket terminals 118*a* and 118*b* on the lamp socket 115 side and the engagement terminal 168 on the light body structure 101 side are engaged and electrically connected. By this engagement, the lamp socket 115 is retained at the lamp lighting position.

As described above, the process of connecting a electric power cable and a feed wire to the light body mounting base 11, the process of fixing the light body mounting base 11 to the ceiling board 1 and the process of mounting the light body 12 to the light body mounting base 11, are all simplified and thereby both time and labor of work are saved.

What is more, the engagement of the hook pawl 164 of each hook type power receiving terminal 161 the upper face of each hook type power supply terminal 82 stabilizes the stopping condition, compared with a stopping construction using sheet springs of a prior art. Further, since the hook pawl 164 of each hook type power receiving terminal 161 is pressed against the upper face of its respective hook type power supply terminal 82 by the weight of the light body 12, the contract pressure and electrical connection of each hook type power receiving terminal 161 with its respective hook type power supply is ensured. Also, since the stopper projection part 84 is arranged in the hook type power supply terminal 82, even when the light body 12 is rotated in a direction where the hook pawl part 164 of each hook type power receiving terminal 161 is pressed to the upper face of its hook type power supply terminal 82 is moved toward the insert hole part 79, the hook pawl 164 touches the stopper projection part 84 and restricts the movement, and thus the light body 12 does not unexpectedly fall from the light body mounting base 11.

Also, as shown in FIG. 9, since a space is formed between the guide hole part 61 of the lamp mounting base 11 and the guide projection part 184 of the light body 12, heat is discharged from the top of the light body through the space and thereby improves heat dissipation.

Further, to replace the light body 129, by rotating the lamp socket 115 to the vertical lamp replacement/removal position which is nearly vertical to the irradiation opening 104, this enables easy replacement/removal of lamp 129. Because the electric connection of the lamp socket 115 and the hook type power receiving terminal 161 by the electrical connection means 183 is accomplished by rotating the lamp socket 115 to the lamp replacement/removal position, the lamp 129 is always replaced/removed under a condition no electric power to the lamp socket 115.

To remove the light body 12 for maintenance and device exchange, the light body 12 is rotated counterclockwise, viewed from the bottom face, while pushing up on the light body 12. The hook pawl part 164 of each hook type power receiving terminal 161 passes above the stopper projection part 84 of its hook type power supply terminal 82 to face above the insert hole part 79. When the upward force on the light body 12 is released, the light body 12 is moved upward and the hook pawl part 164 of each hook type power receiving terminal 161 is removed from each inner hole part 79 downward, and thus it is possible to remove the light body 12 downward from the light body insert part 28 of the light body mounting base 11.

Thereby, since remounting of the light body 12 is not made difficult because of the removal of the light body 12, it is possible to easily detach and remove the light body 12 for maintenance.

Further, when the light body mounting base 11 is removed from the ceiling board 1 for maintenance and device exchange, by raising the stopper body 39 correlatively in relation to the light body mounting base 11 by moving the movement body 38 upward (an embodiment direction) by operating the feed screw 37, holding of the ceiling board 1 by the flange part 23 is canceled. By moving the movement body 38 upward, an outer face of the stopper body 39 engages the guide tip part 47. The guide tip part 47 moves the stopper body 39 to the non-engagement position near the frame part 22. Thereby, by moving the light body mounting base 11 downward, it is possible to easily remove the light body mounting base 11 from the fitting hole 2 of the ceiling board 1.

Since remounting of the light body mounting base 11 is not made difficult because of the removal of the light body mounting base 11, it is possible to easily release and remove the light body mounting base 11 for maintenance.

As described above, by inserting the frame part 22 of the light body mounting base 11 into the fitting hole 2 of the ceiling board 1, even when the stopper body 39 protrude from the frame part 22, it is possible to insert the stopper body 39 while retreating toward the non-engagement position because the stopper body 39 touches an inner brim of the fitting hole 2, and further, since the stopper body 39 after passing the fitting hole 2 is again forced outward toward the engagement position beside the frame part 22 by the spring 40. This provisionally fixes the light body mounting base 11 by contact of the stopper body 39 against the rear face side of the ceiling board 1. Since it is possible to clamp the ceiling board 1 between the stopper body 39 and the flange part 23 by operating the feed screw 37 under the provisionally fixed condition, workability is improved.

Further, since the stopper body 39 is enabled to move along the embodiment direction of the frame part 22 and is forced inward by the guide tip part 47 by moving the stopper body 39 toward an upper end part of the embodiment direction, it is possible to ensure each operation, including retreating of the stopper body 39, protruding of the stopper body 39 and holding of the ceiling board 1 by the stopper body, along with such movements of the stopper body 39.

What is more, since the stopper body 39 is enabled to move along the embodiment direction of the frame part 22 and is rotated toward the non-engagement position and the engagement position with its end in the embodiment direction as a support point, it is possible to make smooth the retreating of the stopper body 39 toward the non-engagement position.

Also, since the light body 12 is easily guided into the light body mounting base 11 by the guide projection part 184 at the top of the light body structure 101, and since the pair of hook type power receiving terminals 161 which are provided concentrically around the guide projection part 184 can easily be positioned in relation to the hook type power supply terminal 82 of the light body mounting base 11 side, it is possible to improve workability.

Further, since the hook type power receiving terminal 161 is located near the guide projection part 184, it is possible to improve a positioning accuracy of the hook type power receiving terminal 161.

Still further, by the guide hole part 61 provided at the top of the frame part 22 of the light body mounting base 11, the light body 12 can easily be incorporated to the frame part 22 and the pair of hook type power supply terminals 82 which are arranged concentrically around the guide hole part 61 and the hook type power receiving terminal 161 can easily be positioned, and thus it is possible to improve a workability of the light body 12 with regard to the light body mounting base 11.

Still further, since the annular part 62 is arranged around the guide hole part 61 at the top of the frame part 22 and since the hook type power supply terminal 82 is arranged in the ring-shaped part 62, it is possible to save the material of the frame part 22 and easily obtain a concentrical position of the pair of hook type power supply terminals 82 around the guide hole part 61.

What is more, since the terminal block 63 is provided at the top of the frame part 22 and no special terminal block is separately required, it is possible to reduce the number of parts and to simplify.

Also, since the light body 12 can be connected both electrically and mechanically to the light body mounting base 11 and yet the base structure 21 and the light body structure 101 are made of a plastic material, it is possible to omit a special insulation structure for the connection means 76 and the hook type power receiving terminal 161. Thus it is possible to improve a workability of the light body 12 and simplify a construction of both the light body mounting base 11 and the light body 12.

Further, since a plastic material has a specific gravity of below 2 and heat conductivity of at least 3 cal/cm$^3$ is used for the base structure 21 and the light body structure 101, it is also possible to improve heat dissipation of a lamp during lighting by means of the plastic made base structure 21 and light body structure 101. Also, using a glass fiber reinforced plastic having a specific gravity of below 2 and a thermal conductivity of at least 3 cal/cm$^3$, it is possible to improve heat dissipation of the lamp 129 during lighting as well as its rigidity and heat resistance. Additionally, if the specific gravity is 2 or more, it makes the weight too large and makes a light-weight design difficult. If the heat conductivity is 3 cal/cm$^3$ or less, it is not possible to obtain sufficient heat dissipation. Additionally, by commonly using the reflection body 102, it is possible to freely choose a light control body to be attached to a lower part of the reflection body 102 and obtain an optional light control effect.

Figure 10:
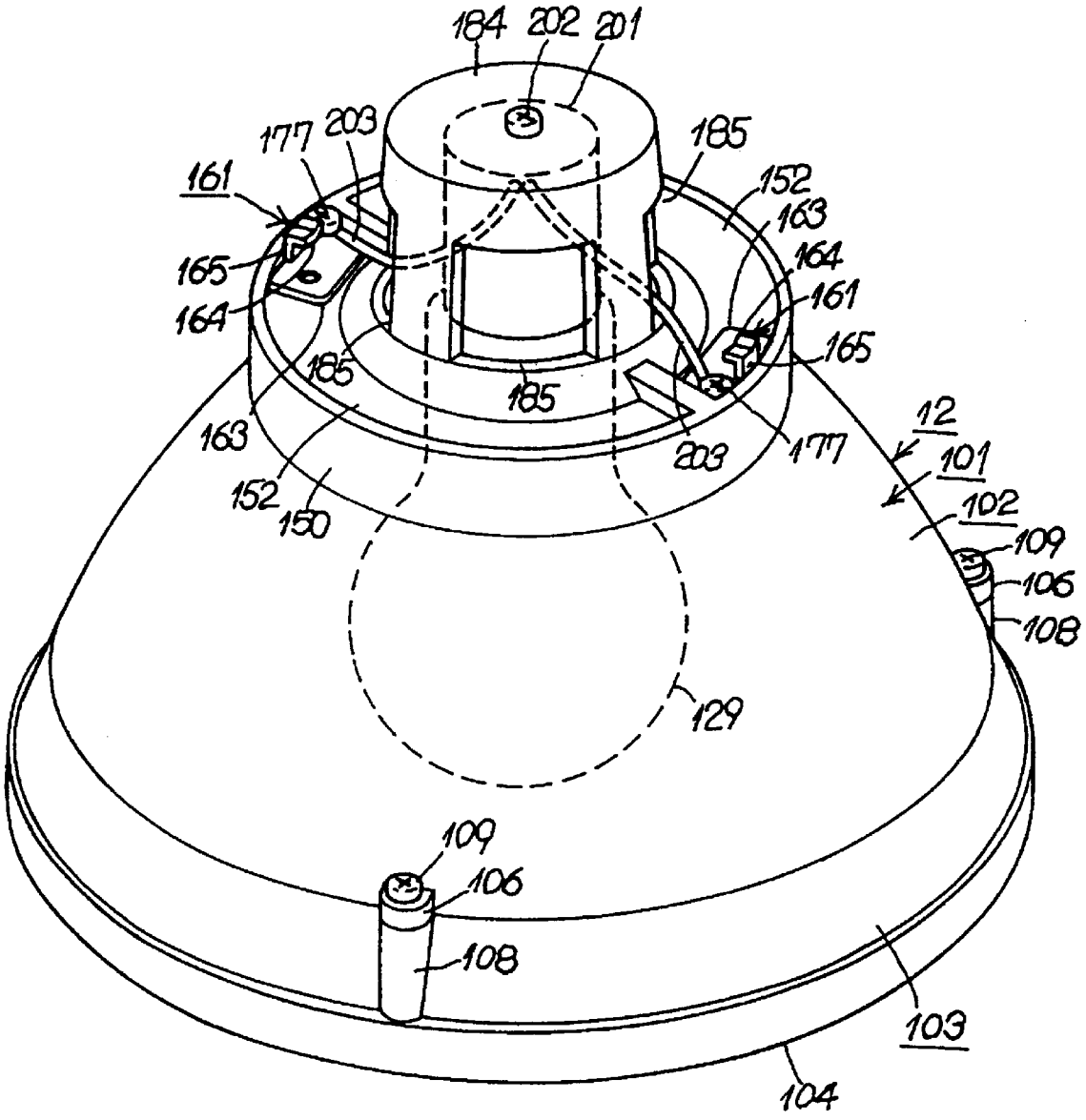
FIG. 10 is a perspective view of a light body showing a second embodiment of the present invention.

Referring now to FIG. 10, in a second embodiment of the invention, the light body 12 is a vertical type in which a lamp connection direction is vertical to the irradiation opening 104. The guide projection part 184 at a top part of the light body 12 extends upward. A lamp socket 201 is arranged inside the guide projection part 184 and fixed with a fitting screw 202 which is inserted from above the guide projection part 184 and threaded into the lamp socket 201. A pair of lead wires 203 extending from the lamp socket 201 are respectively connected a hook type power receiving terminal 161.

Thus, like the shallow type light body 12, the vertical type light body 12 too is mounted in the same way to the light body mounting base 11 and displays the same effects.

Additionally, for the light body 12, when the light body 12 is enabled to be inserted into the light body insert part 28 of the light body mounting base 11, it is possible to mount different types of light body 12 to the light body mounting base 11. Accordingly, when the light body mounting base 11 is standardized and the light body mounting base 11 is fixed to the ceiling board 1, it is possible to selectively mount different types of light bodies 12, and replacement can also be made easily.

Figure 11:
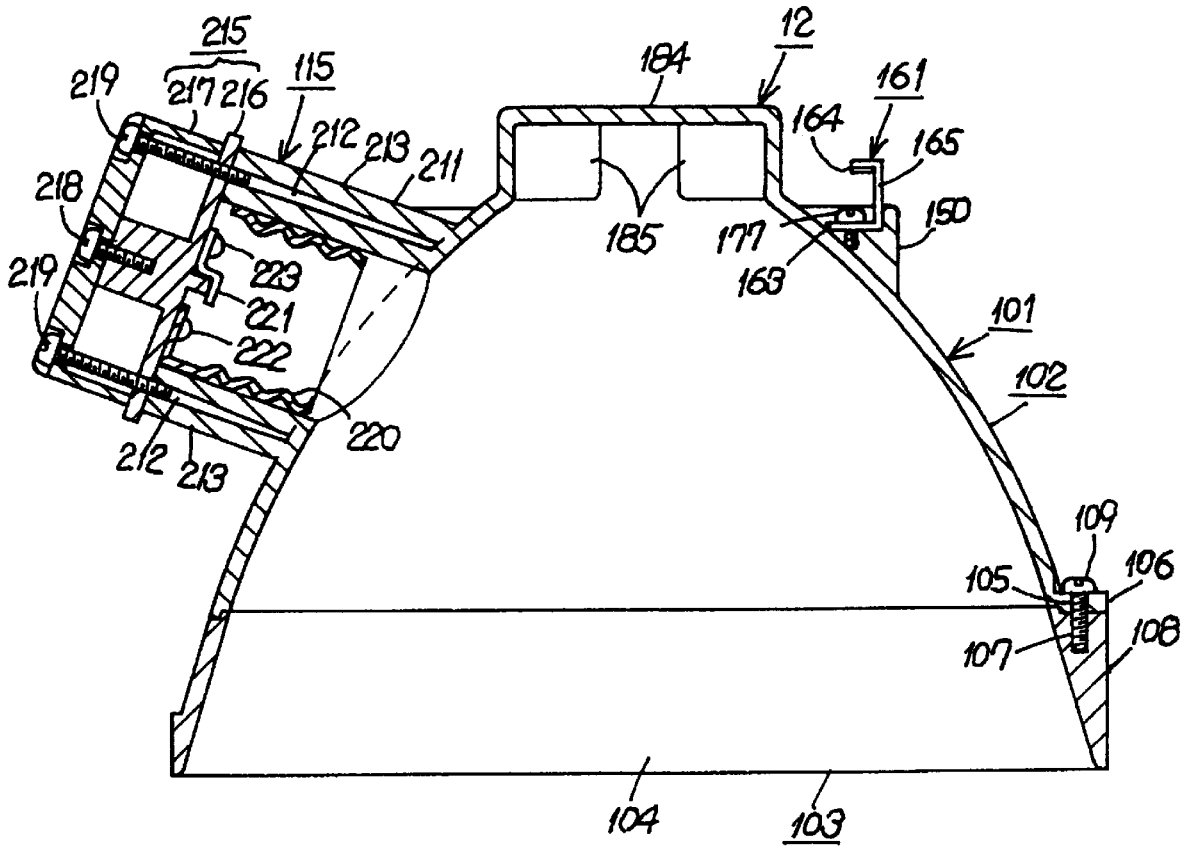
FIG. 11 is a sectional view of a light body showing a third embodiment of the present invention.
Figure 12:
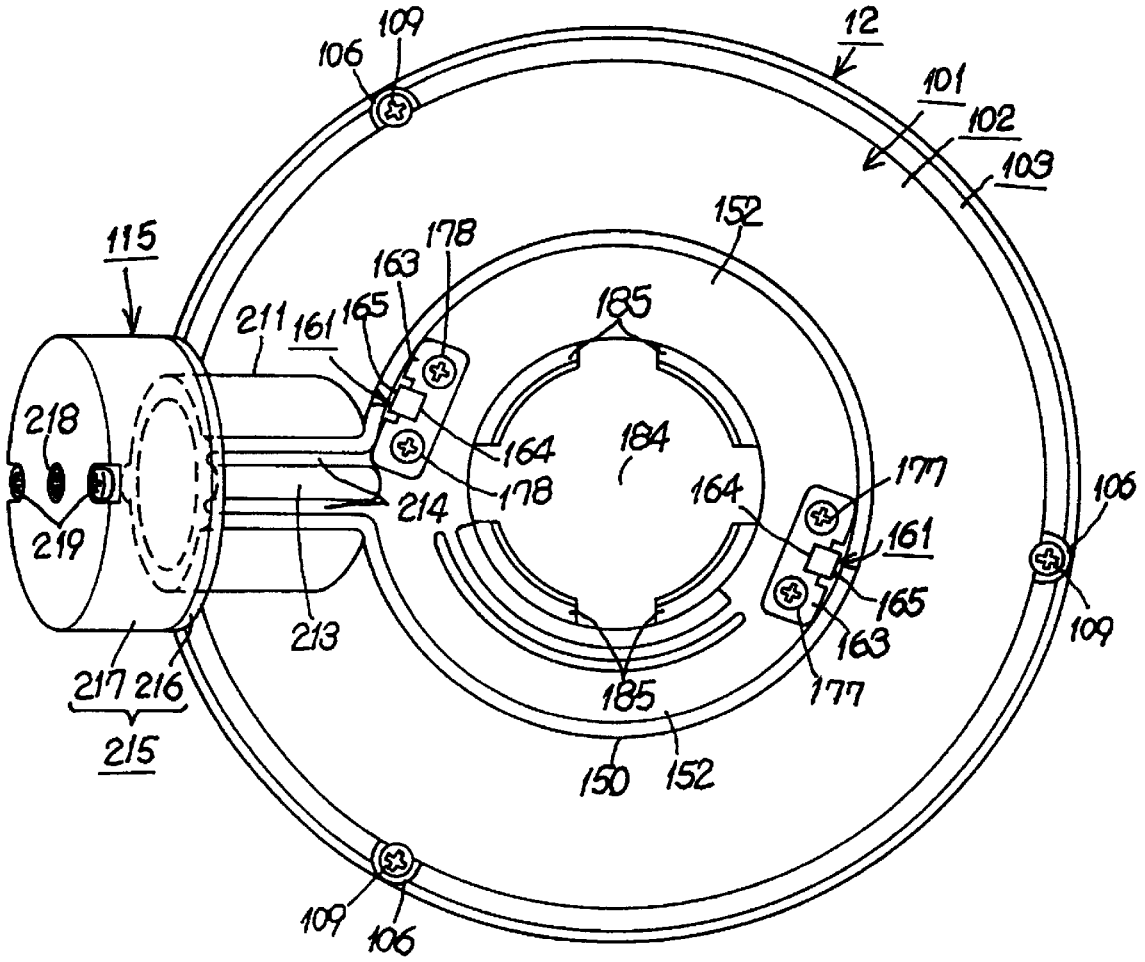
FIG. 12 is a perspective view of the light body.

Referring now to FIG. 11, a further embodiment of the invention includes a light body 12 in which the lamp socket 115 protrudes diagonally upward from a middle part of a side face of the reflection body 12. The lamp socket 115 has a tubular part 211 which is formed integrally with the reflection body 102. In upper and lower faces of the tubular part 211, there are formed bosses 213 having fitting holes 212. On both sides of the boss 213 of the upper face, there is formed a wiring concave part 214 receiving a pair of unillustrated wires to be connected to the pair of hook type power receiving terminals 161.

At the other end of the tubular part 211, there is attached an end body 215 for closing its opening. The end body 215 has a fitting plate 216 and a cover 217. The fitting plate 216 and the cover 217 are fixed with a fitting screw 218 which is threaded through an outside center of the cover 217 into the fitting plate 216. This combination is fixed to the tubular part 211 with a pair of fitting screws 219 which are threaded through a proximity of upper and lower edges of an upper face of the cover 217 into fitting holes 212.

In the fitting plate 216, there are fitted, as electrically conductive structures inside the tubular part 211 to which the lamp 129 is connected, a bracket 220 and a contact terminal 221 respectively with fitting screws 222 and 223. The bracket 220 and contact terminal 221 are connected respectively to above-mentioned pair of wires by fitting screws 222 and 223 between the fitting plate 216 and the cover 217.

Thus, by forming the lamp socket 115 monolithically with the reflection body 102 and by making the reflection body 102 with a plastic material, together with an advantage of omitting a special insulation structure with regard to the hook type power receiving terminal 161, it is possible to simplify a construction of the light body structure 101.

As described above, a light body, a light body mounting base and an embedded lighting equipment according to the present invention are suitable for use as an embedded lighting equipment, such as a ceiling fixture, for example, and by optionally combining the same with a light body and a light body mounting base, it is possible to form various types of embedded lighting equipment.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A light body comprising:

a light body structure having a main reflection plate;

said light body structure has a projection part formed monolithically at a top part of said light body structure;

said main reflection plate is generally concave;

a lamp:

said lamp has a light emitting part;

a lamp socket affixed to said light body structure, wherein said lamp socket positions said light emitting part of said lamp with respect to said main reflection plate;

a connector fixed to said light body structure;

said connector is a hook type connector arranged around said projection part and said connector electrically connects and mechanically supports said light body structure.

2. A light body as claimed in claim 1 wherein:

said light body structure is a plastic material having a specific gravity of below 2 and has a thermal conductivity of at least 3 cal/cm$^3$.

3. A light body as claimed in claim 1 wherein:

said light body structure is a glass fiber reinforced plastic material having a specific gravity of below 2 and has a thermal conductivity of at least of 3 cal/cm$^3$.

4. A light body as claimed in claim 1 wherein:

said light body structure has a tubular light control body which is connected to a lower end of said main reflection plate.

5. A light body as claimed:in claim 1 wherein:

a ventilation hole is disposed around said projection part.

6. A light body as claimed in claim 1 wherein:

a ventilation hole is disposed around said projection part; and said lamp socket is arranged in a middle part of said light body structure.

7. A light body as claimed in claim 1 wherein:

said light body structure has a projection part which is formed monolithically at a top part of said light body structure and a flat part which is formed around said projection part, and said connector is a hook type connector arranged in said flat part.

8. A light body as claimed in claim 1 wherein:

said lamp socket has a tubular part disposed on said light body structure;

said tubular part has a facing end and an open end;

said facing end faces said main reflection plate;

an end body fixed to said open end of said tubular part such that said open end is closed;

an electrically conductive structure mounted to said end body, such that said electrically conductive structure positions said tubular part, and said electrically conductive structure connects to said lamp.

9. A light body mounting base for mounting in a fitting hole of a fitting face comprising:

a base structure is removably disposed within said fitting hole;

said base structure has a frame part;

said base structure also has a bridge part which stands from said frame part;

a light body having a connector;

said light body is removably coupled to said base structure;

a terminal block;

said terminal block is disposed on said base structure such that said terminal block connects to an electric power cable and a feed wire;

a connection means couples said base structure to said light body;

said connection means has an annular part disposed on said bridge part and receives a top part of said light body; and said connection means electrically connects and mechanically supports said base structure to said light body.

10. A light body mounting base for mounting in a fitting hole of a fitting face as claimed in claim 9 wherein:

said base structure is made using a plastic material having specific gravity of below 2 and a thermal conductivity of at least 3 cal/cm$^3$.

11. A light body mounting base for mounting in a fitting hole of a fitting face as claimed in claim 9 wherein:

said base structure is made using a glass fiber reinforced plastic material having a specific gravity of below 2 and a thermal conductivity of at least 3 cal/cm$^3$.

12. A light body mounting base for mounting in a fitting hole of a fitting face as claimed in claim 9 wherein:

said base structure has a bridge part which stands from said frame part;

at least one heat dissipation space formed between said bridge part and a top part of said light body;

said connection means has an annular part disposed on said bridge part, said annular part defines said at least one of said heat dissipation space.

13. A light body mounting base for mounting in a fitting hole of a fitting face as claimed in claim 9 wherein:

said base structure has a bridge part which stands from said frame part;

said connection means has an annular part disposed on said bridge part, said connection means connects to a top part of said light body; and said connection means includes a concave groove coupled to said connector of said light body.

14. A light body mounting base for mounting in a fitting hole of a fitting face as claimed in claim 9 wherein:

said engagement means has an engagement part;

said engagement part protrudes outward from said frame part and engages with said fitting face;

a feed screw having a stopper part;

said feed screw is disposed on said frame part and is operable from said fitting face;

means for fitting said light body within said fitting hole;

said means for fitting is moveably operable by said feed screw;

said stopper part is elastically biased to resist movement toward a non-engagement position with regard to said fitting face when said stopper part is moved toward a prescribed position; and said stopper part is also elastically biased toward an engagement position with regard to said fitting face when said stopper part is moved toward a position other than said prescribed position, and in cooperation with said engagement part, holds said fitting face.

15. A light body mounting base for mounting in a fitting hole of a fitting face as claimed in claim 9 wherein:

said connection means and said terminal block are formed monolithically with said base structure.

16. An embedded type lighting device comprising:

a light body structure having a main reflection plate;

said main reflection plate is substantially concave;

a lamp includes a light emitting part;

said light body structure has a lamp socket disposed therein;

said lamp socket positions said light emitting part within said main reflection plate;

a light body mounting base;

said light body mounting base has a connector;

said connector electrically connects and mechanically supports said light body structure;

said light body mounting base fits into a fitting hole disposed in a fitting face;

said light body mounting base has a frame part disposed therein;

said light body mounting base also has a terminal block disposed therein such that said light body mounting base electrically connects an electric power cable and a feed wire; and a connection means for coupling said terminal block to said connector of said light body.

17. An embedded type lighting device as claimed in claim 16 wherein:

said base structure has a bridge part which stands from said frame part;

said connection means includes a hook type connector disposed on said bridge part;

said connector is electrically and mechanically connectable to said connection means, and said lamp socket protrudes outward from a position, in a middle part of said light body structure and within a rotation range of said light body structure, whereby said lamp socket rotatable clears said bridge part, to provide access to said lamp.

18. A light body as claimed in claim 16 wherein:

said light body structure is a plastic material having a specific gravity of below 2 and has a thermal conductivity of at least 3 cal/cm$^3$.

19. A light body as claimed in claim 16 wherein:

said light body is a glass fiber reinforced plastic material having a specific gravity of below 2 and a thermal conductivity of at least of 3 cal/cm$^3$.

20. A light body as claimed in claim 16 wherein:

said light body structure has a tubular light control body which is connected to a lower end of said main reflection plate.

21. A light body as claimed in claim 16 wherein:

said light body structure has a projection part which is formed monolithically at a top part of said light body structure.

22. A light body as claimed in claim 16 wherein:

said light body structure has a projection part which is formed monolithically at a top part of said light body structure and a ventilation hole which is formed around said projection part.

23. A light body as claimed in claim 16 wherein:

said light body structure has a projection part which is formed monolithically at a top part of said light body structure and a ventilation hole which is formed around said projection part, and said lamp socket is arranged in a middle part of said light body structure.

24. A light body as claimed in claim 16 wherein:

said light body structure has a projection part which is formed monolithically at a top part of said light body structure, and said connector is a hook type connector arranged around said projection part.

25. A light body as claimed in claim 16 wherein:

said light body structure has a projection part which is formed monolithically at a top part of said light body structure and a flat part which is formed around said projection part, and said connector is a hook type connector arranged in said flat part.

26. A light body as claimed in claim 16 wherein:

said lamp socket has a tubular part disposed on said light body structure has a facing end and an open end;

said facing end facing said main reflection plate;

an end body fixed to said open end of said tubular part closing said open end;

an electrically conductive structure mounted to said end body; and said electrically conductive structure positionable within said tubular part and connectable to said lamp.

* * * * *